US008852067B2

(12) United States Patent
Houdijk et al.

(10) Patent No.: US 8,852,067 B2
(45) Date of Patent: Oct. 7, 2014

(54) GARMENT BOX

(71) Applicant: United Parcel Service of America, Inc., Atlanta, GA (US)

(72) Inventors: Gijs Houdijk, Eindhoven (NL); Koen De Greef, Eindhoven (NL); Frits Stam, Eindhoven (NL)

(73) Assignee: United Parcel Service of America, Inc., Atlanta, GA (US)

( * ) Notice: Subject to any disclaimer, the term of this patent is extended or adjusted under 35 U.S.C. 154(b) by 0 days.

(21) Appl. No.: 14/013,750

(22) Filed: Aug. 29, 2013

(65) Prior Publication Data

US 2013/0345036 A1 Dec. 26, 2013

Related U.S. Application Data

(62) Division of application No. 13/494,393, filed on Jun. 12, 2012, now Pat. No. 8,544,641.

(51) Int. Cl.
*B31B 1/26* (2006.01)

(52) U.S. Cl.
USPC ..... 493/162; 493/79

(58) Field of Classification Search
USPC ..... 493/162, 69, 79, 68, 52
See application file for complete search history.

(56) References Cited

U.S. PATENT DOCUMENTS

| | | | | |
|---|---|---|---|---|
| 2,508,579 | A | 5/1950 | Mcfall | |
| 3,999,657 | A * | 12/1976 | Doskocil | 206/289 |
| 4,119,197 | A * | 10/1978 | Pilz | 206/279 |
| 4,158,406 | A * | 6/1979 | Feder | 206/279 |
| 4,318,472 | A | 3/1982 | Nauheimer et al. | |
| 4,342,389 | A | 8/1982 | Bethune et al. | |
| 4,402,404 | A | 9/1983 | Nauheimer | |
| 4,416,371 | A * | 11/1983 | Nauheimer | 206/289 |
| 4,678,079 | A | 7/1987 | Henning | |
| 5,505,298 | A | 4/1996 | Dlugopolski | |
| 5,687,902 | A * | 11/1997 | Tusing et al. | 229/198.1 |
| 6,155,415 | A | 12/2000 | Runyan | |
| 6,302,323 | B1 * | 10/2001 | Southwell | 229/164 |

FOREIGN PATENT DOCUMENTS

JP 6156557 A 6/1994

OTHER PUBLICATIONS

International Searchiing Authority, International Search Report and Written Opinion for International Application No. PCT/US2012/042020, mailed Feb. 11, 2013, 12 pages, European Patent Office, The Netherlands.

* cited by examiner

*Primary Examiner* — Sameh H. Tawfik
(74) *Attorney, Agent, or Firm* — Alston & Bird LLP

(57) ABSTRACT

Various embodiments provide a method for making a garment box insert. The method comprises the steps of performing a plurality of folding actions upon a first side wall, a second side wall, a third side wall, and a fourth side wall so as to form a container portion. Extended flap portions and fold-over panels are further provided and folded so as to enclose and define the container portion. A first walled enclosure portion is further formed by performing steps of folding the second and first fold-over panels such that an elongate slot and at least to apertures are appropriately aligned. The method concludes with inserting one or more tabs of the first walled enclosure portion into one or more oval slots in the first side wall, so as to selectively secure the first walled portion relative to the first side wall during use.

4 Claims, 19 Drawing Sheets

GARMENT BOX

CROSS-REFERENCE TO RELATED APPLICATIONS

This application claims priority to and the benefit of U.S. application Ser. No. 13/494,393, filed Jun. 12, 2012, the contents of which are hereby incorporated herein by reference in their entirety.

BACKGROUND

There are many instances in which individuals wish to ship garments such as shirts, dresses, jackets, skirts, pants, etc. in a box using a common carrier and/or the post office. However, in many instances, boxes used for shipping garments must be specifically configured so that they remain upright during transport; otherwise the garments slide down in the box. Such is undesirable because the garments may become curled up, disarranged, disheveled, and/or wrinkled when they slide down in the box. Furthermore, if the garments are placed on hangers and the hangers are not also properly secured to restrict or prevent the hangers from movement during shipping, the hangers may break, tear and/or score the garments and/or the box. Therefore, a need exists in the art for a garment box for shipping of garments on hangers that not only secures the hangers so that the garments remain properly arranged in the box, but also permits transport of the box in any orientation.

BRIEF SUMMARY

Various embodiments provide a garment box insert comprising (1) a bottom panel; (2) a container portion comprising a first side wall, a second side wall, a third side wall, and a fourth side wall; and (3) contiguous to the first side wall, a first walled enclosure portion. According to various embodiments: (a) the first side wall, the second side wall, the third side wall, and the fourth side wall are adjacent to and at approximate right angles to the bottom panel; (b) the first side wall and the fourth side wall extend from opposite edges of the bottom panel from one another and are substantially parallel to and facing one another; (c) the first side wall comprises an elongate slot extending along a portion of a length of the first side wall and is disposed proximate a mid-point of the first side wall, the elongate slot being configured to receive and secure a handle portion wherein the handle portion is configured to be engaged by one or more clothes hangers; and (d) the second side wall and the third side wall extend from opposite edges of the bottom panel from one another, are adjacent to the first side wall and the fourth side wall, and are substantially parallel to and facing one another. Still further, the walled enclosure portion comprises: (a) a first fold over panel comprising two apertures configured to receive at least an upper portion of the handle portion; and (b) a second fold over panel adjacent an inside edge of the first fold over panel and at an approximate right angle to the first fold over panel, the second fold over panel comprising an elongate aperture positioned such that the opposing ends of the elongate aperture are approximately aligned with the two apertures of the first fold over panel and a central portion of the elongate aperture being approximately aligned with the elongate slot located in the first side wall, wherein the alignment allows the one or more heads of clothes hangers to be inserted through the elongate aperture of the second fold over panel and secured on a lower portion of the handle portion.

Various embodiments further provide a method for making a garment box insert, wherein the garment box insert comprises: a bottom panel and a container portion comprising a first side wall, a second side wall, a third side wall, and a fourth side wall, each adjacent to the bottom panel, the first side wall and the fourth side wall being on opposite sides of the bottom panel from one another, the first side wall comprising one or more substantially oval slots and an elongate slot disposed proximate a mid-point of the first side wall and configured to receive and secure a handle portion wherein the handle portion is configured to be engaged by one or more heads of clothes hangers, the second side wall and the third side wall being on opposite sides of the bottom panel from one another, and adjacent to the first side wall and the second side wall; and contiguous to the first side wall, a first walled enclosure portion comprising: one or more tabs, a first fold over panel comprising two apertures substantially centered about a mid-point of the first fold over panel, a second fold over panel adjacent an inside edge of the first fold over panel and comprising an elongate aperture located proximate a mid-point of the second fold over panel, opposing ends of the elongate aperture being approximately aligned with the two apertures of the first fold over panel and a central portion of the elongate aperture being approximately aligned with the elongate slot located in the first side wall. In these embodiments, the method comprising the steps of: (a) folding the first side wall, the second side wall, the third side wall, and the fourth side wall at approximate right angles relative to the bottom panel so that the first side wall and the fourth side wall are substantially parallel to and facing one another and the second side wall and the third side wall are substantially parallel to and facing one another; (b) forming the container portion by performing the sub-steps of: (1) folding extended flap portions of the first and the fourth side walls such that the extended flap portions are positioned inside the walled enclosure portion and lie substantially juxtaposed with said second and third side walls; and (2) folding down the first fold over panels of the second and the third side walls such that the first fold over panels and corresponding second fold over panels of the second and the third side walls substantially enclose at least a portion of the extended flap portions of the first and the fourth side walls and such that an outer edge of the first fold over panels lays in juxtaposition with the bottom panel; and (c) forming the first walled enclosure portion by performing the sub-steps of: (1) folding up the second fold over panel such that the central portion of the elongate aperture is approximately aligned with the elongate slot located in the first side wall, such that the one or more heads of clothes hangers can be inserted through the elongate aperture of the second fold over panel and secured on a lower portion the handle portion; (2) folding down the first fold over panel such that the first fold over panel lies juxtaposed an outer surface of the first side wall and such that the two apertures are aligned so as to receive at least an upper portion of the handle portion; and (3) inserting said one or more tabs of the first walled enclosure portion into said one or more substantially oval slots of the first side wall, so as to selectively secure the first walled enclosure portion relative to the first side wall during use.

Various embodiments likewise provide a blank configured to be used to form a garment box, the blank comprising: (1) a bottom panel; (2) a container portion comprising a first side wall, a second side wall, a third side wall, and a fourth side wall; and (3) contiguous to the first side wall, a first walled enclosure portion. According to these embodiments: (a) the first side wall, the second side wall, the third side wall, and the fourth side wall are adjacent to and configured to bend at approximate right angles to the bottom panel; (b) the first side wall and the fourth side wall extend from opposite edges of the bottom panel from one another and are configured to be substantially parallel to and facing one another upon being bent; and (c) the second side wall and the third side wall extend from opposite edges of the bottom panel from one another, are adjacent to the first side wall and the fourth side wall, and are configured to be substantially parallel to and facing one another upon being bent. Still further, the walled enclosure portion comprises: (a) two apertures configured to receive at least an upper portion of the handle portion; and (b) a second fold over panel adjacent an inside edge of the first fold over panel and at an approximate right angle to the first fold over panel, the second fold over panel comprising an elongate aperture positioned such that the opposing ends of the elongate aperture are approximately aligned with the two apertures of the first fold over panel and a central portion of the elongate aperture being approximately aligned with the elongate slot located in the first side wall, wherein the alignment allows the one or more heads of clothes hangers to be inserted through the elongate aperture of the second fold over panel and secured on a lower portion of the handle portion.

Still further various embodiments provide a garment box assembly comprising: a box; and a garment box insert configured for positioning within the box. In these various embodiments, the garment box insert comprises: (1) a bottom panel; (2) a container portion comprising a first side wall, a second side wall, a third side wall, and a fourth side wall; and (3) contiguous to the first side wall, a first walled enclosure portion. According to various of these and other embodiments: (a) the first side wall, the second side wall, the third side wall, and the fourth side wall are adjacent to and at approximate right angles to the bottom panel; (b) the first side wall and the fourth side wall extend from opposite edges of the bottom panel from one another and are substantially parallel to and facing one another; (c) the first side wall comprises an elongate slot extending along a portion of a length of the first side wall and is disposed proximate a mid-point of the first side wall, the elongate slot being configured to receive and secure a handle portion wherein the handle portion is configured to be engaged by one or more clothes hangers; and (d) the second side wall and the third side wall extend from opposite edges of the bottom panel from one another, are adjacent to the first side wall and the fourth side wall, and are substantially parallel to and facing one another. Still further, the walled enclosure portion comprises: (a) a first fold over panel comprising two apertures configured to receive at least an upper portion of the handle portion; and (b) a second fold over panel adjacent an inside edge of the first fold over panel and at an approximate right angle to the first fold over panel, the second fold over panel comprising an elongate aperture positioned such that the opposing ends of the elongate aperture are approximately aligned with the two apertures of the first fold over panel and a central portion of the elongate aperture being approximately aligned with the elongate slot located in the first side wall, wherein the alignment allows the one or more heads of clothes hangers to be inserted through the elongate aperture of the second fold over panel and secured on a lower portion of the handle portion.

BRIEF DESCRIPTION OF THE SEVERAL VIEWS OF THE DRAWING(S)

Having thus described the invention in general terms, reference will now be made to the accompanying drawings, which are not necessarily drawn to scale.

DETAILED DESCRIPTION OF VARIOUS EMBODIMENTS

Figure 1:
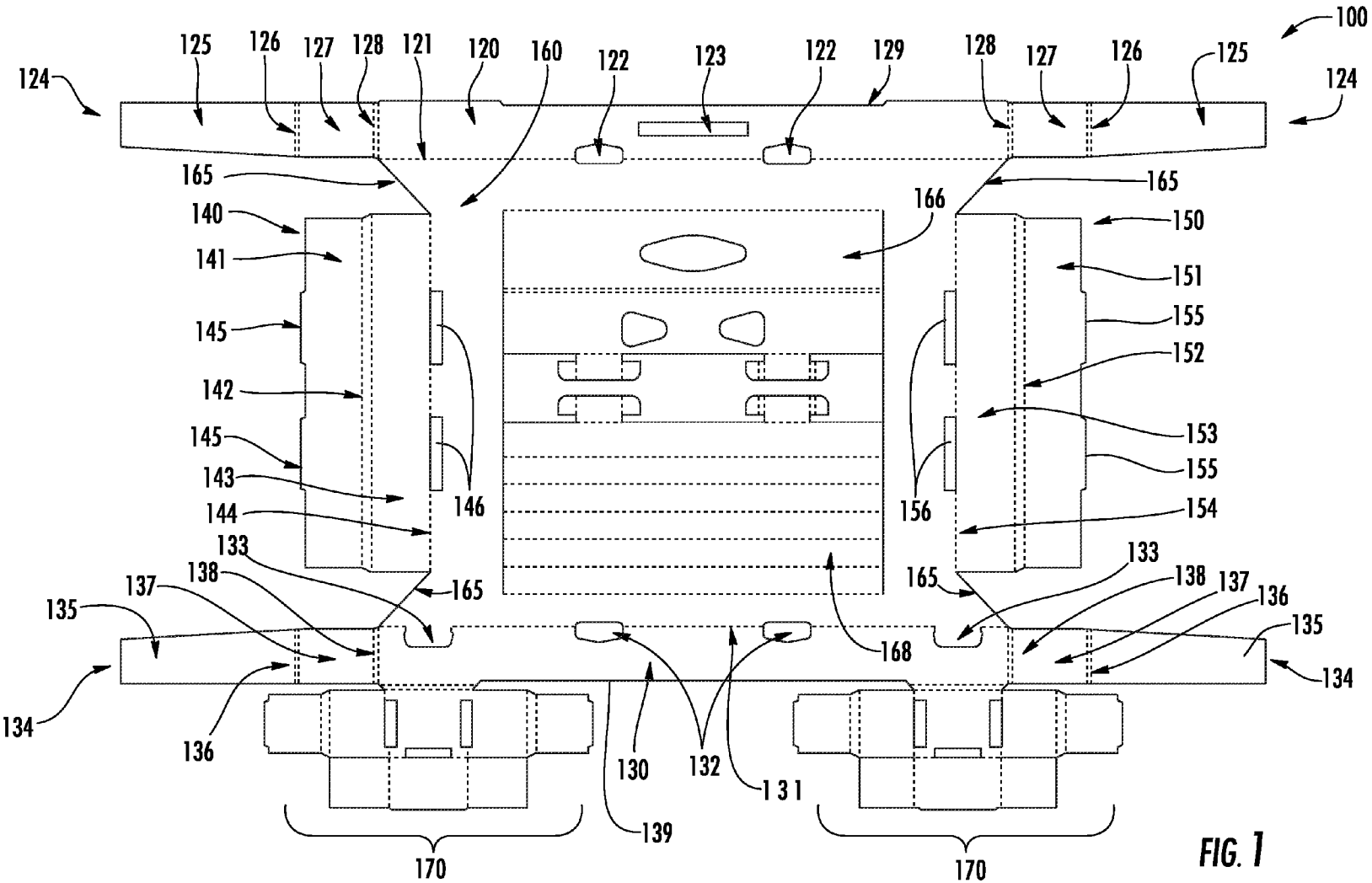
FIG. 1 shows a top view of an arrangement of a blank 100 used to make an insert for a garment box according to various embodiments.

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Unless otherwise defined, all technical and scientific terms used herein have the same meaning as commonly understood by one of ordinary skill in the art to which this invention belongs. The terminology used in the description is for describing particular embodiments only and is not intended to be limiting to embodiments of the present invention. As used in the description, the singular forms "a," "an," and "the" are intended to include the plural forms as well, unless the context clearly indicates otherwise. The term "or" is used herein in both the alternative and conjunctive sense, unless otherwise indicated. The terms "illustrative" and "exemplary" are used to be examples with no indication of quality level.

Unless otherwise indicated, all numbers expressing quantities of dimensions such as length, width, height, and so forth as used in the description are to be understood as being modified in all instances by the term "about." Accordingly, unless otherwise indicated, the numerical properties set forth in the description are approximations that may vary depending on the desired properties sought to be obtained in embodiments of the present invention. Notwithstanding that the approximate numerical ranges and parameters setting forth the broad scope of embodiments of the present invention, the numerical values set forth in the specific examples are reported as precisely as possible. Any numerical values, however, inherently contain certain errors necessarily resulting from error found in their respective measurements.

Still further, while numbers expressing quantities of dimensions such as length, width, height, and sort forth are incorporated throughout the description, such as to be understood as exemplary in nature, versus limiting. In other words, certain embodiments may have dimensions substantially greater than the exemplary numbers expressed herein, while other embodiments may have dimensions substantially less than the same, as may be desirable for particular applications. It should be understood that such variations in dimensions are contemplated and considered within the scope of various embodiments, provided the dimensional aspects of the blank 100 as a whole provide the previously described benefits of securing and retaining a garment for transport within a garment box. Accordingly, for purposes of brevity of disclosure, such variations may be assumed with regard to any remaining described dimensions herein, even where not explicitly described with regard to particular panels or elements.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

I. Structure of Exemplary Garment Box Blank

FIG. 1 provides an illustration of a blank 100 that may be used to make an insert 1001, which may, in turn, slide into an outer shell 1002 so as to form a garment box 1000 (see also FIGS. 11-13) according to various embodiments. In certain embodiments, the insert 1001 is formed by carrying out a sequence of folding steps upon the blank 100. In particular embodiments, the blank 100 is folded along appropriate single and/or double-formed crease lines and respective panels (e.g., folding panels, as referred to later herein) are thereby brought by the folding operation into proximity or juxtaposition to other panels, or made to abut or to interlock with other panels of the blank 100, as described in further detail below.

In various embodiments, the single and double-formed crease lines are configured to encourage bending at the crease lines. For instance, in various embodiments, the crease lines may be formed by placing indentations in the blank 100, by partial cuts through the body of the blank 100, by placing serrated indentations in the body of the blank 100 that include alternating sections of cuts through the body of the blank and sections without cuts, and/or combinations thereof. It should be generally understood, however, that the double crease lines according to various embodiments are generally configured such that folding thereupon will permit capture of one or more additional panels between the two being folded relative to one another along the double crease line. In contrast, the single crease lines according to various embodiments are configured such that folding thereupon will not permit capture of yet another panel between the two being folded, as described in further detail below.

For convenience, the blank 100 is shown in FIG. 1 as a single flat item that may be manufactured as a single piece. However, it should be apparent to one of ordinary skill in the art in light of this disclosure that the blank 100 may be manufactured in multiple pieces that may be adhered to one another through such mechanisms as tape, glue, staples, etc., and/or a combination thereof. In addition, according to various embodiments, the blank 100 may be constructed of any suitable material such as the non-limiting examples of paperboard, cardboard, thermoplastic polymers, polystyrene, polyvinyl chloride, nylon, rubber, or cardboard. In certain embodiments, the suitable material may be formed at least partially or even wholly from recyclable, reground, and/or biodegradable material, as may be desirable in particular applications.

It may be seen from FIG. 1 that various embodiments of the blank 100 include a bottom panel 160, a first side wall 120, a second side wall 140, a third side wall 150, and a fourth side wall 130. Each of the respective walls and panels may be substantially rectangular in shape, and dimensions for each may vary among embodiments. For instance, in certain embodiments, with reference to FIG. 14, which depicts various dimensions in terms of millimeters, the bottom panel 160 may measure approximately 20⅝ inches by 22³⁄₁₆ inches (i.e., approximately 524 millimeters by 564 millimeters), the first and fourth side walls 120, 130 may each measure approximately 2⁵⁄₁₆ inches by 49⅜ inches (i.e., approximately 59 millimeters by 1254 millimeters), and the second and third side walls 140, 150 may each measure approximately 4⅞ inches by 18 inches (i.e., approximately 124 millimeters by 457 millimeters). As mentioned previously, it should be understood that in other embodiments, these and still other dimensions of the blank 100 may be substantially greater than or substantially less than those recited above, as may be desirable for transport of particularly sized garments. For purposes of brevity, such variations may be assumed with regarding to any remaining described dimensions.

Returning now with more particular emphasis upon FIG. 1, the insert 1001 of the garment box 1000 for holding the garments may be formed by first folding the first side wall 120 along a single crease line 121 between the first side wall 120 and the bottom panel 160 at an approximate right angle and folding the fourth side wall 130 along a single crease line 131 between the fourth side wall 130 and the bottom panel 160 at an approximate right angle so that the first side wall 120 and the fourth side wall 130 are substantially parallel to and facing one another. In certain embodiments, the first side wall 120 includes apertures 122, 123, while the fourth side wall 130 includes apertures 132 and tabs 133. Each of the apertures 122, 132 and tabs 133 lie substantially adjacent each of the crease lines 121, 131, respectively, while the aperture 123 is positioned substantially centrally between the crease line 121 and the receiving portion (e.g., edge) 129 of the first side wall. In particular embodiments, apertures 122, 132 are approximately ⅞ of an inch by 2 inches (i.e., approximately 22 millimeters by 51 millimeters), so as to correspond with and receive tabs 193, 213, as will be described in further detail below. In these and other embodiments, the tabs 133 may be approximately ⅞ of an inch (i.e., approximately 22 millimeters) in length and separable from the fourth side wall 130 so as to receive a portion of the cube portion 170, as will also be described in further detail below.

Figure 12A:
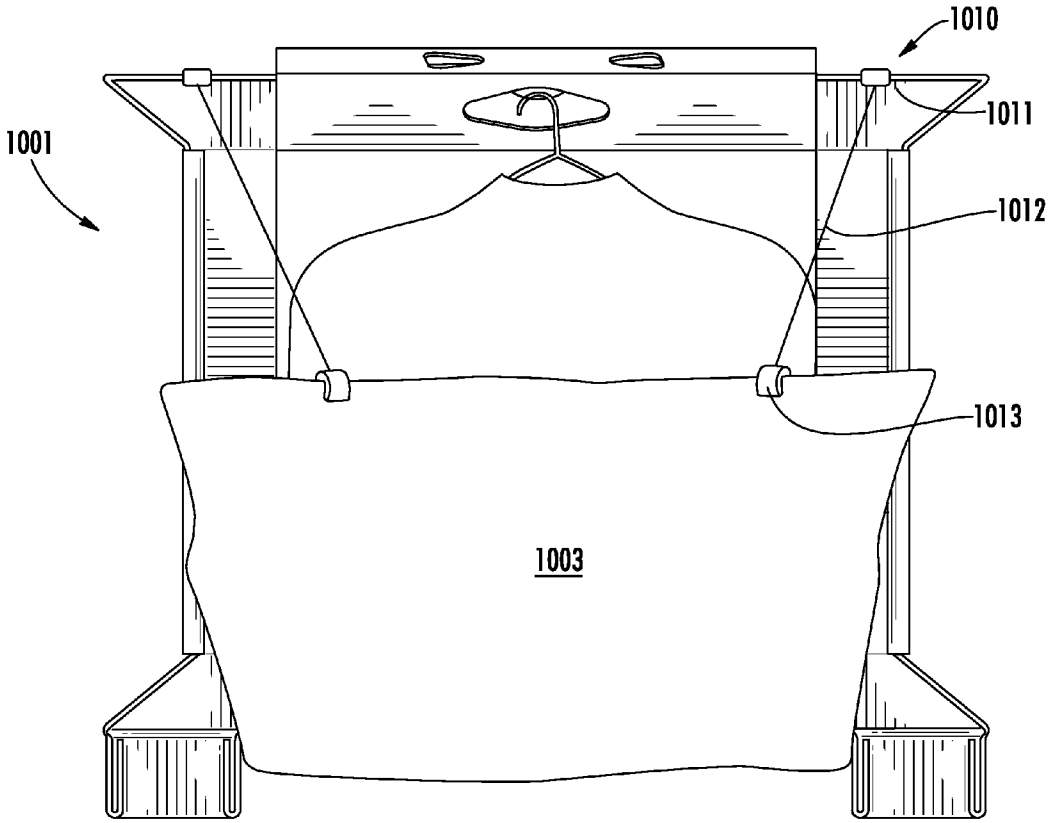
FIG. 12A shows a top view of an insert of a garment box packed with a garment according to various embodiments.
Figure 12B:
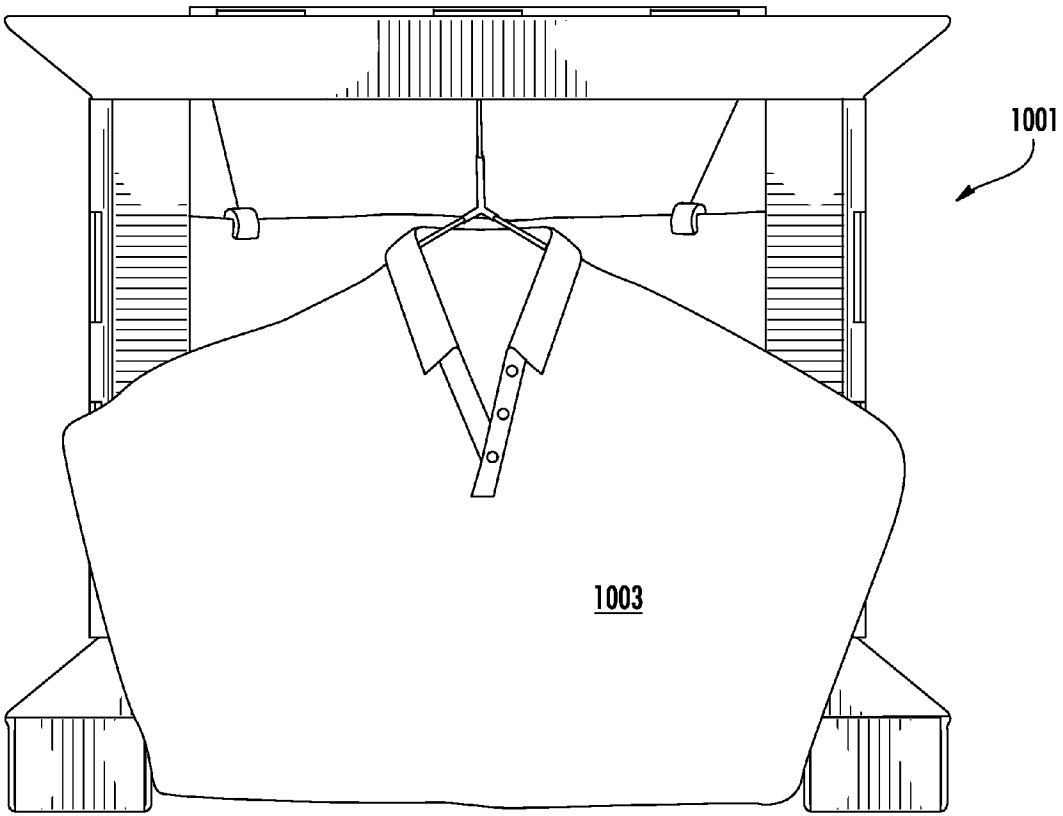
FIG. 12B shows a bottom view of the insert of FIG. 12A according to various embodiments.
Figure 12C:
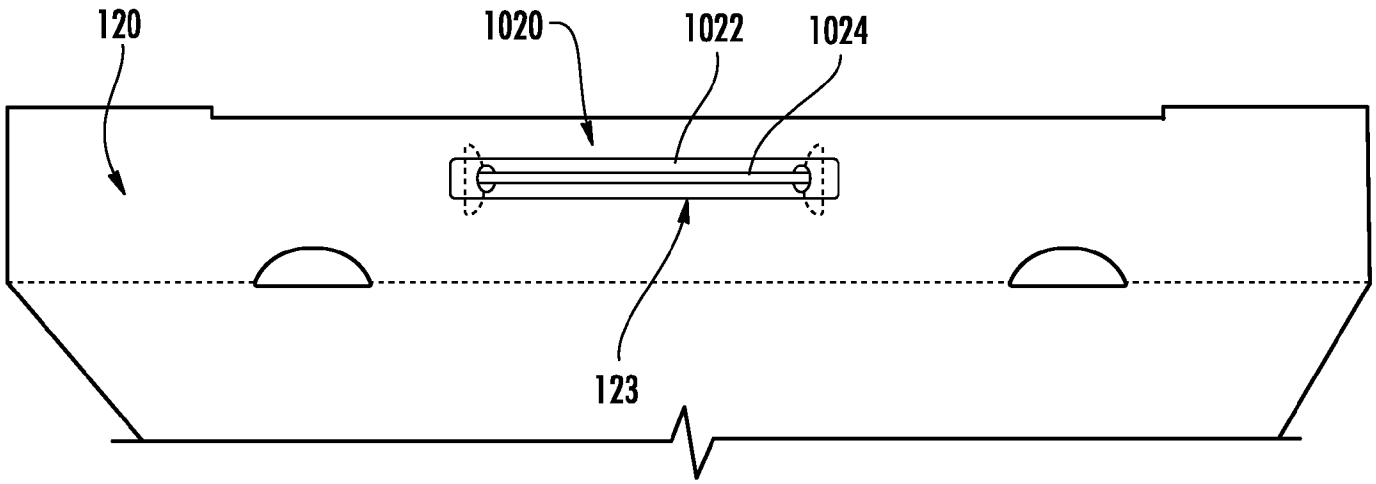
FIG. 12C shows an enlarged top view of an arrangement of the first side wall 120 of the blank 100 used to make the insert of FIG. 12A, further depicting a handle portion 1020 for securing a hanger 1030 within the garment box according to various embodiments.
Figure 12D:
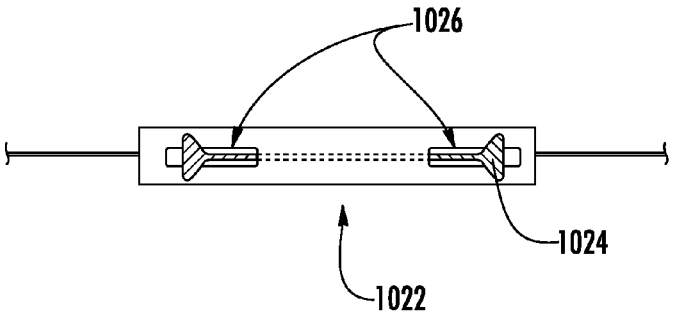
FIG. 12D shows an enlarged top view of the handle portion 1020 of FIG. 12C according to various embodiments.
Figure 12E:
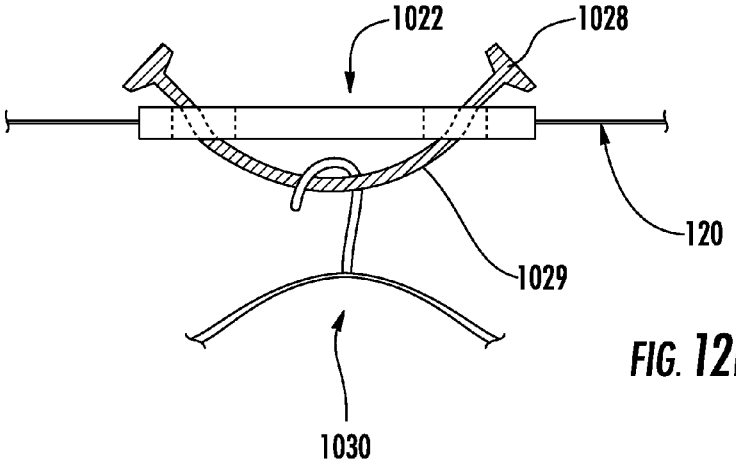
FIG. 12E shows an enlarged side view of the handle portion 1020 of FIGS. 12C-D according to various embodiments.

With reference now also to FIGS. 12C-E, the aperture 123 of the first side wall 120 may be configured according to various embodiments to receive a hanger portion 1020 (e.g., a block) which may be formed from any of a variety of materials, as described previously herein. In at least one embodiment, the hanger portion 1020 is formed from a reinforced plastic material, so as to serve as a strengthening member. In certain embodiments, the hanger portion 1020, once positioned within the aperture 123, may be configured to receive and support a hanger 1030 upon which a garment rests, as described in further detail below. In certain embodiments, with reference again to FIG. 1, the aperture 123 is positioned substantially centrally between the crease line 121 and the receiving portion (e.g., edge) 129 of the first side wall 120 so as to align substantially with the apertures 192, 202, of the first walled enclosure portion 166, when in the folded configuration, again, as will be described in further detail below. In these and other embodiments, the aperture 123 may be approximately 4⁹⁄₁₆ inches by ⅞ of an inch (i.e., approximately 116 millimeters by 22 millimeters). In those embodiments having a corresponding hanger portion 1020, the hanger portion may be approximately 4⁹⁄₁₆ inches by ⅞ of an inch (i.e., approximately 116 millimeters by 22 millimeters) so as to snugly fit within the aperture 123. Of course, in still other embodiments, the hanger portion 1020 may be slightly larger dimensionally, so as to facilitate a press fit between the portion and the aperture 123, as may be desirable for particular applications.

Remaining for a moment with FIGS. 12C-12E, it may be understood that according to various embodiments, the hanger portion 1020 may generally comprise a mounting portion 1022 and a hanger handle 1024. The mounting portion 1022 may, in certain embodiments, be sized, as described above, so substantially mate with and engage the aperture 123. In these and other embodiments, the mounting portion 1022 may be provided with a pair of elongate slots 1026 through which the hanger handle 1024 may slidably travel during use, as will be described in further detail below. In at least the illustrated embodiment, tab portions 1028 of the hanger handle 1024 may be configured such that the handle does not fully slide out of the elongate slots 1026, but remains locked therein. In at least the illustrated embodiment, the hanger portion 1020 and its respective elements may be formed from a plastic material, whether recycled in part or whole, or otherwise created. Of course, it should be understood that still other embodiments may incorporate any of a variety of types of mechanisms (e.g., whether differing in shape, size, material, or the like), provided such is configured to receive and support a hanger 1030, as generally considered desirable for the garment box described herein.

Figure 3:
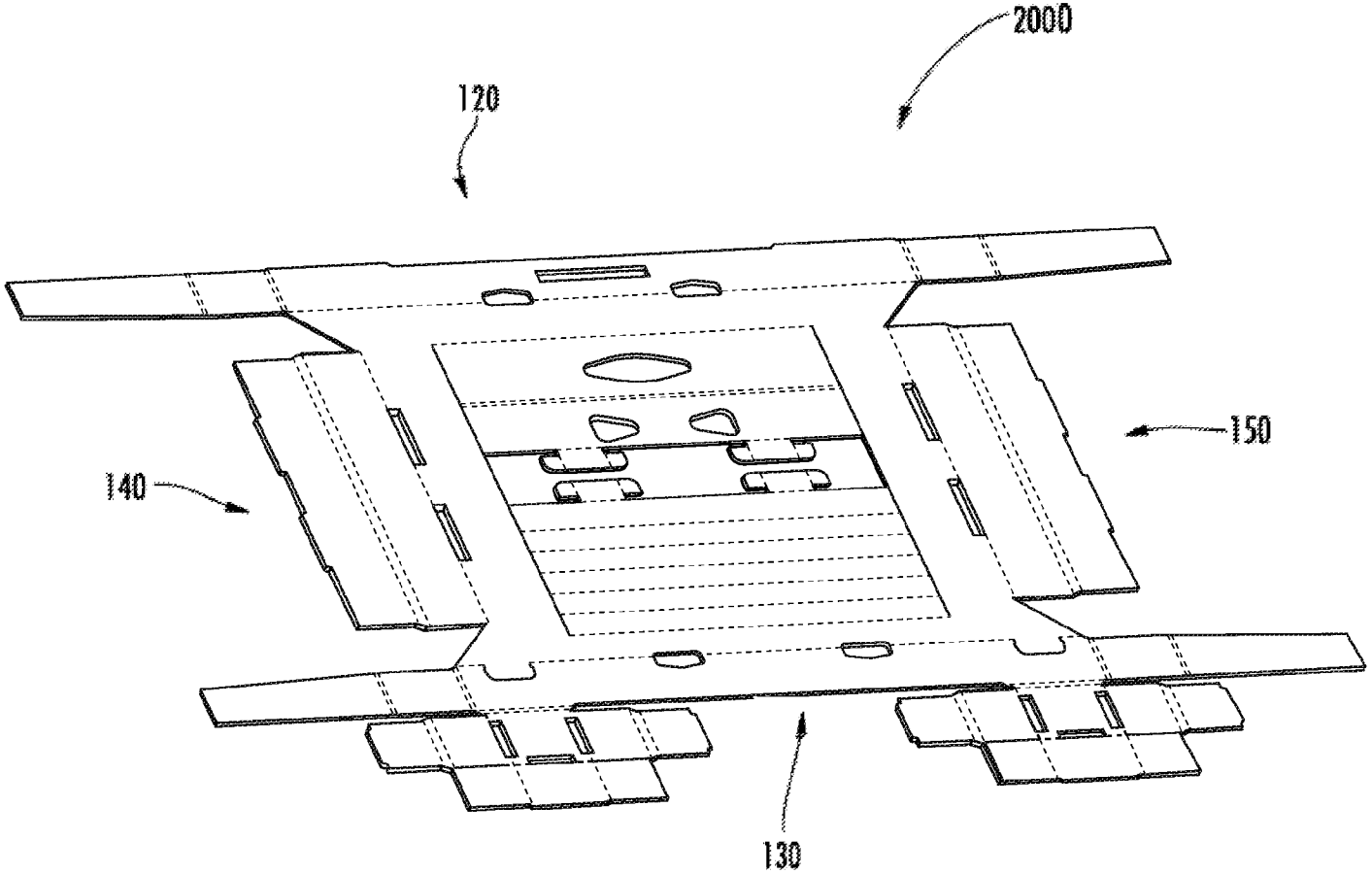
FIG. 3 shows a perspective view of a blank used to make an insert for a garment box during the assembly process according to various embodiments.

Returning now to FIG. 1 and the first side wall 120 and the fourth side wall 130 of blank 100, such may each comprise a pair of first and second fold-over panels (125, 127), (135, 137), respectively. Focusing first upon the panels of the first side wall 120, a container portion 2000 (see also FIGS. 3 and 10) of the blank 100 may be first realized by folding the first fold-over panel 125 outward along a double crease line 126 and the second fold-over panel 127 inward along a double crease line 128. While the particular details of the folding process will be described in further detail below, it should be understood that in various embodiments, the second fold-over panel 127 is configured to correspond substantially in length with a flange 165 of the bottom panel 160, while the first fold-over panel 127 is configured to correspond substantially in length to approximately half of the length of either of the second and third side walls 140, 150. In certain embodiments, the second fold-over panel 127 is approximately 3¼ inches by 2⁵⁄₁₆ inches (i.e., approximately 83 millimeters by 59 millimeters), while the first fold-over panel 125 is approximately 7½ inches by 2⁵⁄₁₆ inches (i.e., approximately 191 millimeters by 59 millimeters). It should be understood that the crease lines 126, 128 may have generally corresponding lengths, namely approximately 2⁵⁄₁₆ inches (i.e., approximately 59 millimeters). Still further, in these and still other embodiments, the first and second fold-over panels 135, 137 of the fourth side wall 130 are dimensioned substantially the same as those of the first side wall.

In this manner, with reference not only to FIG. 1, but also to FIG. 5 (as will be described in further detail below), the first and fourth side walls 120, 130, together with their respective pairs of first and second fold-over panels (125, 127), (135, 137) form a wall having a height of approximately 2⁵⁄₁₆ inches (i.e., approximately 59 millimeters) that creates a periphery of the container portion 2000 (see also FIGS. 3 and 10) of the insert 1001(see FIGS. 11-12B), into which at least one garment 1003 may be placed and positioned, as described in further detail below. Of course, it should be understood that in other embodiments, the height may be substantially greater (or alternatively less than) 2⁵⁄₁₆ inches (i.e., approximately 59 millimeters), as may be desirable for particular applications. As a non-limiting example, at least one exemplary embodiment may be configured such that two or three garments may be placed within the garment bag, in which case a height in the range of approximately three to four inches may be beneficial. In such an embodiment, the outer shell 10 would, of course, be comparably dimensioned, so as to receive such an insert, as will be described in further detail below.

Returning now to FIG. 1 according to various embodiments, the container portion 2000 (see also FIGS. 3 and 10) may be further formed by the second side wall 140 of blank 100. In certain embodiments, the second side wall 140 may be configured to substantially enfold (e.g., encircle and/or encase) at least the first fold-over panels 125, 135 of the first and fourth side walls 120, 130, as will be described in further detail below. In at least the illustrated embodiment, the second side wall 140 may be formed by folding a first fold-over panel 141 along a crease line 142 and a second fold-over panel 143 along a crease line 144. In various embodiments, the height of the panels 141, 143 may be approximately 2½ inches (i.e., approximately 64 millimeters). In this fashion, the height of the panels is, in these and still other embodiments, substantially greater than the height of approximately 2⁵⁄₁₆ inches (i.e., 59 millimeters) of the fold-over panels 125, 135.

In various embodiments, the complete dimensions of each of the panels 141, 143 of the second side wall 140 may be approximately 2½ inches by 15⅜ inches (i.e., approximately 64 millimeters by 391 millimeters), such that a corresponding dimension of the second side wall in its entirety would be approximately 5 inches by 15⅜ inches (i.e., approximately 127 millimeters by 391 millimeters). In any of these embodiments, the length of the crease lines 142, 144 generally correspond to the length of the panels and/or walls, namely making the lines approximately 15⅜ inches (i.e., approximately 391 millimeters) in length. In certain embodiments, at least the first panel 141 of the second side wall 140 may further comprise one or more tabs 145, which may be configured generally to be inserted and accepted within one or more apertures 146 substantially adjacent crease line 144. In at least one embodiment, the tabs 145 and corresponding apertures 146 may exist in pairs, each having dimensions of approximately 3/16 of an inch by 2 inches (i.e., approximately 5 millimeters by 51 millimeters), in which case the tabs would extend into the apertures by approximately 3/16 of an inch (i.e., approximately 5 millimeters). In this and still other embodiments, it should be understood that the tabs 145 may be additionally secured within the apertures 146 and thus relative to at least one of the first and second side walls 120, 140 using various adhesion mechanisms such as tape, glue, staples, etc., and/or a combination thereof. In at least the illustrated embodiment, however, the tabs 145 have been formed as an integral part of the second side wall 140, as may be desirable for particular applications.

In an analogous manner to that described above with regard to the second side wall 140, the container portion 2000 (see also FIGS. 3 and 10) may be further formed by the third side wall 150 of blank 100. In certain embodiments, the third side wall 150 may be configured to substantially enfold (e.g., encircle and/or encase) at least the first fold-over panels 125, 135 of the first and fourth side walls 120, 130, as will be described in further detail below. In at least the illustrated embodiment, the third side wall 150 may be formed by folding a first fold-over panel 151 along a crease line 152 and a second fold-over panel 153 along a crease line 154. In various embodiments, the height of the panels 151, 153 may be approximately 2½ inches (i.e., approximately 64 millimeters). In these and still other embodiments, the height is thus substantially greater than the height of approximately 2 5/16 inches (i.e., approximately 59 millimeters) of the fold-over panels 125, 135.

In various embodiments, the complete dimensions of each of the panels 151, 153 of the third side wall 150 may be approximately 2½ inches by 15⅜ inches (i.e., approximately 64 millimeters by 391 millimeters), such that a corresponding dimension of the second side wall in its entirety would be approximately 5 inches by 15⅜ inches (i.e., approximately 127 millimeters by 391 millimeters). In any of these embodiments, the length of the crease lines 152, 154 generally correspond to the length of the panels and/or walls, namely making the lines approximately 15⅜ inches (i.e., approximately 391 millimeters) in length. In certain embodiments, at least the first panel 151 of the third side wall 150 may further comprise one or more tabs 155, which may be configured generally to be inserted and accepted within one or more apertures 156 substantially adjacent crease line 154. In at least one embodiment, the tabs 155 and corresponding apertures 156 may exist in pairs, each having dimensions of approximately 3/16 of an inch by 2 inches (i.e., approximately 5 millimeters by 51 millimeters), in which case the tabs would extend into the apertures by approximately 3/16 of an inch (i.e., approximately 5 millimeters). In this and still other embodiments, it should be understood that the tabs 155 may be additionally secured within the apertures 156 and/or to the first and second side walls 120, 140 using various adhesion mechanisms such as tape, glue, staples, etc., and/or a combination thereof. In at least the illustrated embodiment, however, the tabs 155 have been formed as an integral part of the third side wall 150, as may be desirable for particular applications.

It should be further understood that although the second and third side walls 140, 150 have been described as having substantially the same characteristics and dimensions, such may not necessarily be the case in all of the various embodiments. Indeed, as a non-limiting example, the number of tabs 145 on the second side wall 140 may differ in number from those tabs 155 on the third side wall 150, as may be desirable for a particular application. Still further, one or more of the second and third side walls 140, 150 may be alternatively configured as compared to how described herein, again as may be desirable for particular applications, and such should be considered as likewise within the scope of the present disclosure. In a similar fashion, although the first and fourth side walls 120, 130 have been described thus far as having substantially the same characteristics and dimensions, at least the fourth side wall may have one or more additional features, configured for interfacing with one or more cube portions 170, as will be described in further detail below. That being said, it should be understood that, however precisely configured and/or dimensioned, the previously described characteristics and dimensions of the first, second, third, and fourth side walls 120, 130, 140, and 150 are generally configured so as to create the aforementioned container portion 2000 (see, for example, FIG. 7; see also FIGS. 3 and 10, as referenced previously herein) into which one or more garments may be placed for transport, again, all as will be described in further detail below.

Turning now with particular emphasis upon FIG. 2A, various embodiments of the fourth side wall 130 of the blank 100 may further comprise one or more cube portions 170, which may be configured to provide an offset between a second walled enclosure portion 168 (described later herein) and the peripheral edges of the insert 1001 formed from the blank. In certain embodiments, amongst other benefits, the cube portions 170 facilitate passage of the one or more garments 1003 from one side to another of the insert 1001, when wrapped around the insert 1001, as visible in FIGS. 12A-B. In other words, the cube portions 170 discourage and/or reduce wrinkling or pinching of the garments 1003 between the insert 1001 and an outer shell 1002 of the garment box 100, as described in further detail later below.

That being said, returning to FIG. 2A, various embodiments of the cube portions 170 may be formed from a pair of first fold-over panels 171, a second fold-over panel 174, a pair of third fold-over panels 177, a fourth fold-over panel 180, and a fifth fold-over panel 183. In certain embodiments, the pair of first fold-over panels 171 may each be substantially square-shaped and have dimensions of approximately 2⅜ inches by 2 5/16 inches (i.e., approximately 60 millimeters by 59 millimeters), with the panel 171 being formed by folding along a crease line 172, likewise having a length of approximately 2 5/16 inches (i.e., approximately 59 millimeters). In other embodiments, as the panel 171 is folded along the crease line 172, the panel is likewise substantially separated from adjacently positioned fourth fold-over panels 180 along a pair of slits 173. In these and still other embodiments, the slits 173 may likewise each have dimensions of approximately 2⅜ inches (i.e., approximately 60 millimeters), corresponding generally to the length of the first fold-over panels 171. Of course, as has been previously mentioned herein, the relative dimensions of any of these features may be substantially greater or substantially less than those exemplary dimensions described herein, as may be desirable for particular applications.

Figure 2A:
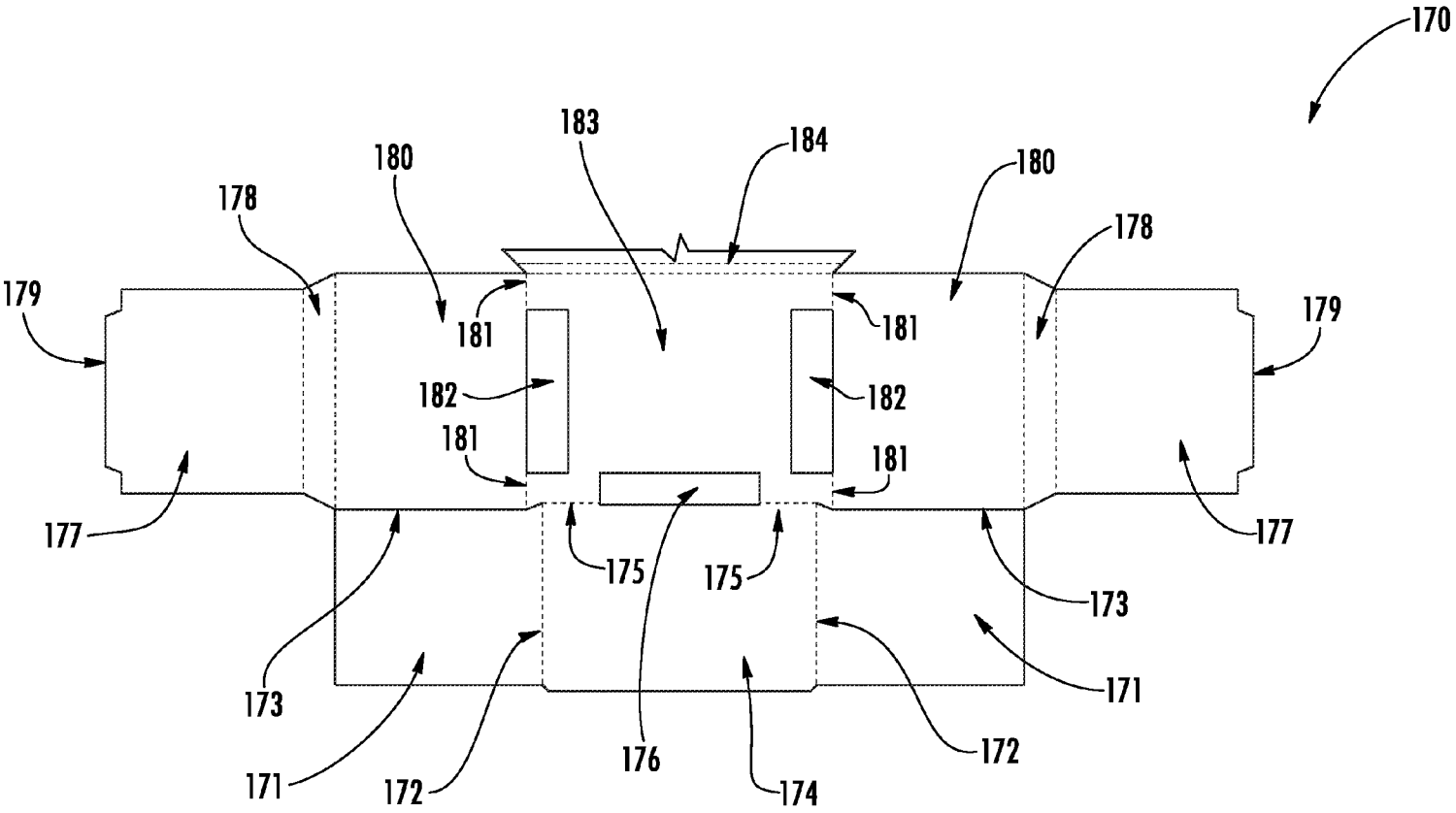
FIG. 2A shows an enlarged top view of an arrangement of a cube portion 170 of the blank 100 used to make an insert for a garment box according to various embodiments.

Remaining with FIG. 2A, according to various embodiments of the cube portions 170, the second fold-over panel 174 may be substantially square-shaped and have dimensions of approximately 2 7/16 inches by 2 5/16 inches (i.e., approximately 62 millimeters by 59 millimeters). In certain embodiments, the panel 174 may be formed by folding along a crease line 175, which may likewise have a length of approximately 2 7/16 inches (i.e., approximately 62 millimeters). At least the two edges of the panel 174 having dimensions of approximately 2 5/16 inches (i.e., approximately 59 millimeters) correspond with the crease line 172 of the first fold-over panel 171, as previously described herein. At least one of the remaining edges of the panel 174, in at least certain embodiments, that substantially adjacent to the fifth fold-over panel 183 (as will be described further below), may further comprise at least one aperture 176. In at least the illustrated embodiment, the aperture 176 is centrally positioned along the length of the crease line 175 and has dimensions of approximately 2 inches by 7/8 of an inch (i.e., approximately 51 millimeters by 22 millimeters).

In various embodiments, it should be understood that the dimensions and positioning of the aperture 176 are configured such that a tab 133 of the fourth side wall 130 (also previously described herein) will substantially mate with the aperture. In these and still other embodiments, it should be understood that the tabs 133 may be additionally secured within the apertures 176 and/or to the fourth side wall 130 using various adhesion mechanisms such as tape, glue, staples, etc., and/or a combination thereof. In at least the illustrated embodiment, however, the tabs 133 have been formed as an integral part of the fourth side wall 130, as may be desirable for particular applications. Of course, with that in mind, in still other embodiments, the second fold-over panel 174, along with any of its corresponding elements, may be otherwise dimensioned and/or shaped, as may be desirable for particular applications.

Remaining with FIG. 2A, according to various embodiments of the cube portions 170, the third fold-over panels 177 may likewise be substantially square-shaped and have dimensions of approximately 2 7/16 inches by 2 5/16 inches (i.e., approximately 62 millimeters by 59 millimeters). In certain embodiments, the panels 177 may be formed by folding along a double crease line 178, which may likewise have a length of approximately 2 5/16 inches (i.e., approximately 59 millimeters). At least edge of the panel 177 having a dimensional length of approximately 2 5/16 inches (i.e., approximately 59 millimeters) and positioned opposite that corresponding with the double crease line 178 may further comprise a tab 179. In certain embodiments, the tab 179 may have a dimension of approximately 2 inches by 7/8 of an inch (i.e., approximately 51 millimeters by 22 millimeters), so as to correspond and generally mate with at least one aperture 182 of the adjacently positioned fourth fold-over panel 180, as will be described in further detail below.

Remaining with FIG. 2A, according to various embodiments of the cube portions 170, the fourth fold-over panels 180 may be substantially square-shaped and have dimensions of approximately 2 3/8 inches by 2 5/16 inches (i.e., approximately 62 millimeters by 59 millimeters). In certain embodiments, the panel 180 may be formed by folding along a crease line 181, which may likewise have a length of approximately 2 5/16 inches (i.e., approximately 59 millimeters). At least one edge of the panels 180 having dimensions of approximately 2 3/8 inches (i.e., approximately 62 millimeters) correspond with the slit 173 formed therewith and the first fold-over panels 171. At least the one remaining edge of the panels 180, opposite to that adjacent crease line 181 and also having dimensions of approximately 2 5/16 inches (i.e., approximately 59 millimeters), may according to various embodiments correspond further with crease lines 178 of the third fold-over panels 177, as previously described herein.

In these and still other embodiments of the fourth fold-over panels 180, the edge of the panels substantially adjacent the crease line 181 may further comprise at least one aperture 182. In at least the illustrated embodiment, the apertures 182 is centrally positioned along the length of the crease line 181 and has dimensions of approximately 7/8 of an inch by 2 inches (i.e., approximately 22 millimeters by 51 millimeters). In various embodiments, it should be understood that the dimensions and positioning of the aperture 182 are configured such that tabs 179 of the third fold-over panel 177 (as previously described herein) will substantially mate with the aperture. In these and still other embodiments, it should be understood that the tabs 179 may be additionally secured within the apertures 182 and/or to the third fold-over panel 177 using various adhesion mechanisms such as tape, glue, staples, etc., and/or a combination thereof. In at least the illustrated embodiment, however, the tabs 182 have been formed as an integral part of the third fold-over panel 177, as may be desirable for particular applications. Of course, in still other embodiments, the fourth fold-over panels 180, along with any of their corresponding elements, may be otherwise dimensioned and/or shaped, as may be desirable for particular applications.

Remaining with FIG. 2A, according to various embodiments of the cube portions 170, the fifth fold-over panels 183 may be substantially square-shaped and have dimensions of approximately 2 7/16 inches by 2 5/16 inches (i.e., approximately 62 millimeters by 59 millimeters). In certain embodiments, the panels 183 may be formed by folding along a double crease line 184, which may likewise have a length of approximately 2 7/16 inches (i.e., approximately 62 millimeters). At least the two edges of the panels 183 having dimensions of approximately 2 5/16 inches (i.e., approximately 59 millimeters) correspond generally with the crease lines 181 and the adjacently positioned apertures 182, as previously described in the context of the fourth fold-over panels 180. The at least one remaining edge of the panels 183 (e.g., opposite that corresponding to the double crease line 184), further, in at least the illustrated embodiment, corresponds to the crease line 175 and adjacently positioned aperture 176 of the second fold-over panel 174, also as previously described herein. In this manner, the fifth fold-over panels 183 are substantially centrally located between the remaining of the fold-over panels 171, 174, 177, and 180 and the fourth side wall 130, such that folding of each relative to one another results in the cube portions 170, as will be described in further detail below.

It should be further noted that many of the respective panels of the cube portions 170 have been described as having a height dimension of approximately 2 5/16 inches (i.e., approximately 59 millimeters). However, that being said, it should be understood that in certain embodiments the height dimension of the panels corresponds substantially to the height of the fourth side wall 130 in its entirety, as previously described. Accordingly, should the height of the fourth side wall 130 be substantially greater than or less than 2 5/16 inches (i.e., approximately 59 millimeters), as may be desirable for particular applications (e.g., for inserting more than one garment, or the like), it should be understood that the height of the various panels of the cube portions 170 would be likewise adjusted, so as to permit relative folding thereof, as will be described in further detail below.

Figure 2B:
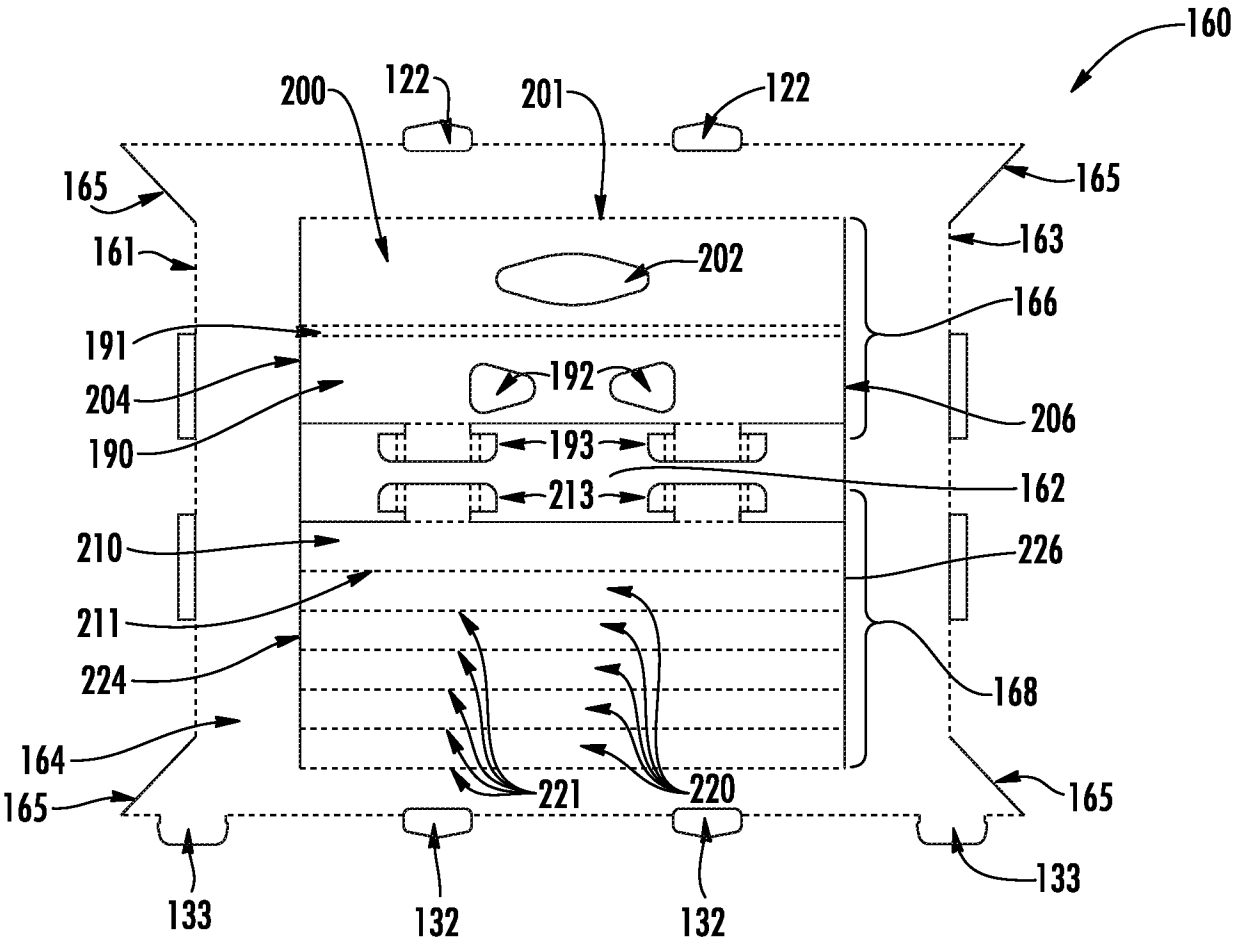
FIG. 2B shows an enlarged top view of an arrangement according to various embodiments of a bottom panel 160 of the blank 100 of FIG. 1.

Turning now with particular emphasis upon FIG. 2B, various embodiments of the bottom panel 160 of the blank 100 may comprise a first walled enclosure portion 166, a second walled enclosure portion 168, a central portion 162, a peripheral portion 164, and a plurality of flanges (e.g., flange portions) 165. In certain embodiments, the peripheral portion 164 may be configured such that it substantially surrounds at least the walled enclosure portions 166, 168 and the central portion 162. In other embodiments, however, the peripheral portion 164 may be configured such that it only partially surrounds those portions, as may be desirable for particular applications. In any of these embodiments, the peripheral portion 164 may have a width of approximately 3⅛ inches (i.e., approximately 80 millimeters). In still other embodiments, the width of the peripheral portion 164, in part, in its entirety, and/or on average, may be substantially greater or less than 3⅛ inches (i.e., approximately 80 millimeters), as may be desirable for particular applications.

Remaining with FIG. 2B and turning with particular emphasis upon the first walled enclosure portion 166, it should be understood that the first walled enclosure portion according to various embodiments may comprise at least a first fold-over panel 190 and a second fold-over panel 200. In certain embodiments, the first fold-over panel 190 may be substantially rectangular-shaped and have dimensions of approximately 16⅜ inches by 2 13/16 inches (i.e., approximately 416 millimeters by approximately 71 millimeters). In these and still other embodiments, the second fold-over panel 200 may be configured and sized substantially the same, such that the first walled enclosure portion 166 may be likewise rectangular-shaped and have dimensions of approximately 16⅜ inches by 5⅝ inches (i.e., approximately 416 millimeters by 143 millimeters). Of course, in still further embodiments, the second fold-over panel 200 and first fold-over panel 190, may be differently sized and/or dimensioned, relative to one another or otherwise, as may be desirable for particular applications.

Returning to solely the first fold-over panel 190, in various embodiments, such may be formed by folding the panel along a crease line 191, likewise having a length of approximately 16⅜ inches (i.e., approximately 416 millimeters). In certain embodiments, as the panel 190 is folded along the crease line 191, the panel is likewise substantially separated from the adjacently positioned peripheral portion 164 of the bottom panel 160 along a pair of slits 204, 206. In these and other embodiments, the slits 204, 206 may likewise each have dimensions of approximately 2 13/16 inches (i.e., approximately 71 millimeters), corresponding generally to the width of the first fold-over panel 190. Of course, in other embodiments, as will be described in further detail below, the slits 204, 206 may be substantially greater in length, corresponding, for example, to a width of the first walled enclosure portion 166 in its entirety. In at least one such embodiment, the slits 204, 206 have a length of approximately 5⅝ inches (i.e., approximately 143 millimeters).

Remaining with FIG. 2B and the first fold-over panel 190, according to various embodiments, the first fold-over panel may comprise a pair of apertures 192. In certain embodiments, the apertures 192 may be both at least partially offset relative to a midpoint of the first fold-over panel 190, such that each corresponds substantially with an end-portion of the aperture 123 of the first side wall 120. As has been described previously herein, the aperture 123 may, according to various embodiments, be sized and configured to receive and secure a hanger portion 1020, and more particularly a mounting portion 1022 of the hanger portion. Accordingly, in these and other embodiments, once the first walled enclosure portion 166 is folded relative to the bottom panel 160 (as will be described in further detail below), the apertures 192 will align with at least a portion of the aperture 123 so as to ensure no interference exists between the first walled enclosure portion and the mounting portion 1022.

Remaining still with FIG. 2B, the second fold-over panel 200 may, in various embodiments, be formed by folding the panel along a crease line 201, likewise having a length of approximately 16⅜ inches (i.e., approximately 416 millimeters). In certain embodiments, as the panel 200 is folded along the crease line 201, the panel is likewise substantially separated from the adjacently positioned peripheral portion 164 of the bottom panel 160 along a pair of slits 204, 206. In these and other embodiments, the slits 204, 206 may likewise each have dimensions of approximately 2 13/16 inches (i.e., approximately 71 millimeters), corresponding generally to the width of the second fold-over panel 200. Of course, in other embodiments, as has been described above, the slits 204, 206 may correspond in their entirety to the total width of the first and second fold-over panels 190, 200. In at least one such embodiment, the slits 204, 206 have a length of approximately 5⅝ inches (i.e., approximately 143 millimeters).

Remaining with FIG. 2B and the second fold-over panel 200, according to various embodiments, the second fold-over panel may comprise an aperture 202 extending across the second fold over panel in a width direction. In certain embodiments, the apertures 202 is located proximate the mid-point of the second fold-over panel 200 and is substantially aligned with a least a central portion of the aperture 123 of the first side wall 120, when the first walled enclosure portion 166 is placed into a folded configuration, as will be described in further detail below. In at least one embodiment, the width of the aperture 202 is approximately 1½ inches (i.e., approximately 38 millimeters). In other embodiments, the dimensions of the aperture 202 may be approximately 1 15/16 inches by 1½ inches (i.e., approximately 49 millimeters by 38 millimeters). In any of these and still other embodiments, the aperture 202 may be approximately oval in shape; however, it should be understood that the aperture may be any of a variety of shapes and/or sizes, provided such substantially corresponds to the dimensions of the aperture 123 of the first side wall 120, as previously described herein.

Remaining for a moment with the aperture 202 of the second fold-over panel 200 and the aperture 123 of the first side wall 120 (and/or its accompanying hanger mounting portion 1022), the aperture 202 is, according to various embodiments, sized and positioned to accommodate the necks of hangers once the heads of the hangers have been secured in the first walled enclosure portion 166, and in particular to the mounting portion 1022 of the first side wall located adjacently thereto. In at least one embodiment, the aperture 202 and the folded configuration of the first walled enclosure portion 166 (as will be described in further detail below) provide a space so that the head of a hanger (e.g., hanger 1030 of FIG. 12E) may pass through the aperture 202 and may be secured within the first walled enclosure portion 166.

Returning now to FIG. 2B and also with reference to FIG. 2C, various embodiments of the first walled enclosure portion 166 further comprise one or more tabs 193, configured to secure the first walled enclosure portion relative to the first side wall 120 of the blank 100, when in the folded configuration, as will be described in further detail below. In certain embodiments, a pair of tabs 193 may be provided each offset relative to a midpoint of the first walled enclosure portion 166. In at least the illustrated embodiment, wherein the tabs 193 exist in pairs, each may have dimensions of approximately 1 7/16 inches by 3½ inches (i.e., approximately 36 millimeters by 88 millimeters). In these and still other embodiments, it should be understood that the one or more tabs 193, particularly when existing in pairs, may be configured to be inserted within correspondingly sized apertures 122 of the first side wall 120.

Indeed, in various embodiments, at least certain portions of the tabs 193 may be configured to secure and retain the tabs 193 within the apertures 122 of the first side wall 120, thereby maintaining the first walled enclosure portion 166, for example, in its folded configuration, as will be described in further detail below, during use. In certain embodiments, the tabs 193 may comprise a pair of first fold-over portions 194 formed relative to a single second fold-over portion 196 along a crease line 195. The second fold-over portion 196 may, in at least the illustrated embodiment, be formed relative to the first walled enclosure portion 166 along crease line 197, although in other embodiments, the second fold-over portion 196 and/or the tabs 193 in their entirety may be formed from a piece of material entirely separate from the first walled enclosure portion 166. In those and still other embodiments, one or more portions of the tabs 193 may be secured relative to the first walled enclosure portion 166 using various adhesion mechanisms such as tape, glue, staples, etc., and/or a combination thereof. Such may, for example, permit reuse of blank 100 even after the typical lifespan of the tabs 193. In still other embodiments, whether the tabs are integrally or separately formed, one or more portions of the tabs 193 further secured relative to the apertures 122 using various adhesion mechanisms such as tape, glue, staples, etc., and/or a combination thereof.

As previously mentioned, in various embodiments, a second walled enclosure portion 168 may be present. With particular emphasis upon FIG. 2B, it should be understood that the second walled enclosure portion according to these embodiments may comprise at least a first fold-over panel 210 and a plurality of additional fold-over panels 220. In certain embodiments, the first fold-over panel 210 may be substantially rectangular-shaped and have dimensions of approximately 16⅜ inches by 1 3/16 inches (i.e., approximately 416 millimeters by 30 millimeters). In these and still other embodiments, the plurality of additional fold-over panels 220 may be configured and sized substantially the same, such that the second walled enclosure portion 168 may, in its entirety, be likewise rectangular-shaped and have dimensions of approximately 16⅜ inches by 8⅞ inches (i.e., approximately 416 millimeters by 225 millimeters). Of course, in still further embodiments, the plurality of additional fold-over panels 220 and the first fold-over panel 210 may be differently sized and/or dimensioned relative to one another or otherwise, as may be desirable for particular applications.

Returning to solely the first fold-over panel 210, in various embodiments, such may be formed by folding the panel along a crease line 211, likewise having a length of approximately 16⅜ inches (i.e., approximately 416 millimeters). In certain embodiments, as the panel 210 is folded along the crease line 211, the panel is likewise substantially separated from the adjacently positioned peripheral portion 164 of the bottom panel 160 along a pair of slits 224, 226. In these and other embodiments, the slits 224, 226 may likewise each have dimensions of approximately 1 3/16 inches (i.e., approximately 30 millimeters), corresponding generally to the width of the first fold-over panel 210. Of course, in other embodiments, as will be described in further detail below, the slits 224, 226 may be substantially greater in length, corresponding, for example, to a width of the second walled enclosure portion 168 in its entirety. In at least one such embodiment, the slits 224, 226 have a length of approximately 8⅞ inches.

Remaining still with FIG. 2B, the plurality of additional fold-over panels 220 may, in various embodiments, be formed by folding each of the panels along a respective one of a plurality of crease lines 221, likewise having a length of approximately 16⅜ inches (i.e., approximately 416 millimeters). In certain embodiments, as each of the panels 220 is folded along each of the crease lines 221, the respective panels are likewise substantially separated from the adjacently positioned peripheral portion 164 of the bottom panel 160 along a pair of slits 224, 226. It should be understood, perhaps with additional reference to FIGS. 11 and 12A that folding of the respective panels in this fashion results in a "rolled up" configuration, which as will be described in further detail below, may substantially receive and secure a garment within the subsequently formed garment box. That being understood, in these and other embodiments, the slits 224, 226 may likewise each have dimensions of approximately 1 3/16 inches (i.e., approximately 30 millimeters), corresponding generally to the width of each one of the plurality of additional fold-over panels 220. Of course, in other embodiments, as has been described above, the slits 224, 226 may correspond in their entirety to the total width of the panels 210, 220. In at least one such embodiment, the slits 224, 226 have a length of approximately 8⅞ inches (i.e., approximately 225 millimeters).

Returning now to FIG. 2B and also with reference to FIG. 2D, various embodiments of the second walled enclosure portion 168 further comprise one or more tabs 213, configured to secure the second walled enclosure portion relative to the fourth side wall 130 of the blank 100, when in the folded configuration, as will be described in further detail below. In certain embodiments, a pair of tabs 213 may be provided each offset relative to a midpoint of the second walled enclosure portion 168. In at least the illustrated embodiment, wherein the tabs 213 exist in pairs, each may have dimensions of approximately 1 7/16 inches by 3½ inches (i.e., approximately 37 millimeters by 89 millimeters). In these and still other embodiments, it should be understood that the one or more tabs 213, particularly when existing in pairs, may be configured to be inserted within correspondingly sized apertures 132 of the fourth side wall 130. Still further, it should be understood that while in certain embodiments, the tabs 213 may be dimensioned and/or configured substantially the same as tabs 193, as described previously herein, in other embodiments, the various tabs 193, 213 may be substantially differently dimensioned and/or configured relative to one another, as may be desirable for particular applications.

Returning now to FIGS. 2B and 2D, according to various embodiments, at least certain portions of the tabs 213 may be configured to secure and retain the tabs 213 within the apertures 132 of the fourth side wall 130, thereby maintaining the second walled enclosure portion 168, for example, in its folded (e.g., "rolled up") configuration, as will be described in further detail below, during use. In certain embodiments, the tabs 213 may comprise a pair of first fold-over portions 214 formed relative to a single second fold-over portion 216 along a crease line 215. The second fold-over portion 216 may, in at least the illustrated embodiment, be formed relative to the second walled enclosure portion 168 along crease line 217, although in other embodiments, the second fold-over portion 216 and/or the tabs 213 in their entirety may be formed from a piece of material entirely separate from the second walled enclosure portion 168. In those and still other embodiments, one or more portions of the tabs 213 may be secured relative to the second walled enclosure portion 168 using various adhesion mechanisms such as tape, glue, staples, etc., and/or a combination thereof. Such may, for example, permit reuse of blank 100 even after the typical lifespan of the tabs 213. In still other embodiments, whether the tabs are integrally or separately formed, one or more portions of the tabs 213 further secured relative to the apertures 132 using various adhesion mechanisms such as tape, glue, staples, etc., and/or a combination thereof.

Figure 14:
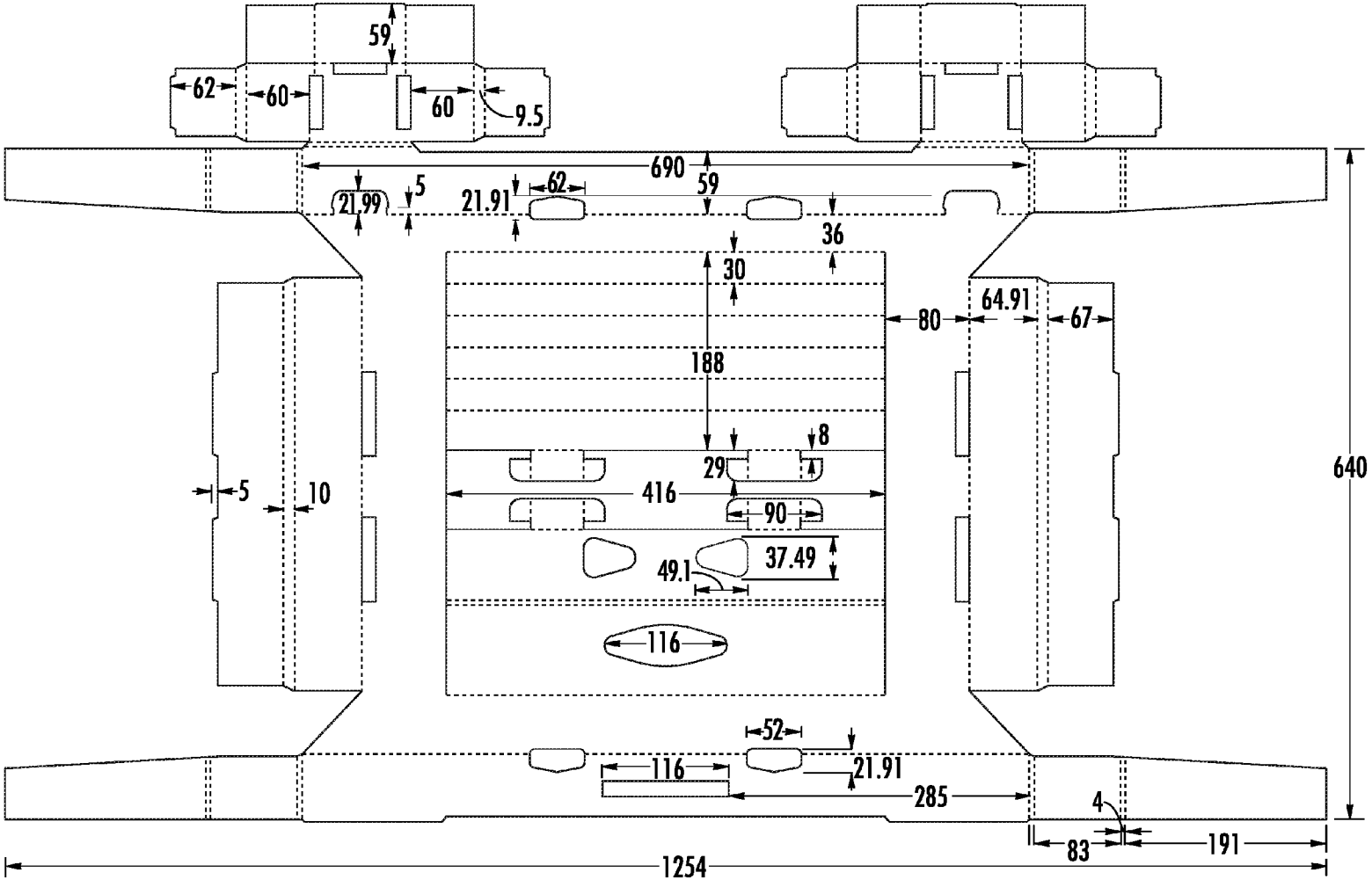
FIG. 14 shows a top view of an arrangement of a blank used to make an insert for a garment box along with accompanying dimensions according to various embodiments.

Turning for a moment with reference to FIG. 14, this figure provides a top view of an arrangement of a blank 100 used to make a garment box, but further illustrates exemplary accompanying dimensions according to various embodiments. It should be noted that although the accompanying dimensions of FIG. 14 are denoted in terms of millimeters, wherein elsewhere herein dimensions have been referenced in terms of inches, such correspond approximately relative to one another, as calculated via standard metric to English conversion rates, as commonly known and understood in the art. Of course, it should be further understood that any of the dimensions of FIG. 14, along with those referenced elsewhere herein are purely exemplary in nature and should not be construed as limiting in any form or fashion.

II. Method of Assembly of Exemplary Garment Box Insert from Blank

FIGS. 3-11 provide an illustration of an assembly of the garment box from a blank 100 according to various embodiments. Looking at FIG. 3, the blank 100 displayed in this figure is substantially the same blank 100 previously described with reference to FIGS. 1-2D. That being said, the assembly of the insert for forming the garment box is performed by carrying out a sequence of folding steps upon the blank 100. The sequence of folding steps is explained as set forth below according to an exemplary embodiment of the invention. However, it should be noted that additional folding steps may be performed in certain embodiments, while in other embodiments the sequence of folding steps need not necessarily be performed in the order provided in the explanation given below. For instance, one may perform the folding steps relating to forming the cube portions of the insert prior to performing the folding steps for the walled enclosure portions, or vice versa. Similarly, one may perform the folding steps related to forming the cube portions of the insert prior to performing the folding steps for the second and third side walls, or vice versa. Thus, it should be understood that the particular sequence of folding steps provided below are for illustrative purposes only and should not be construed to limit the scope of the claimed invention.

Figure 4:
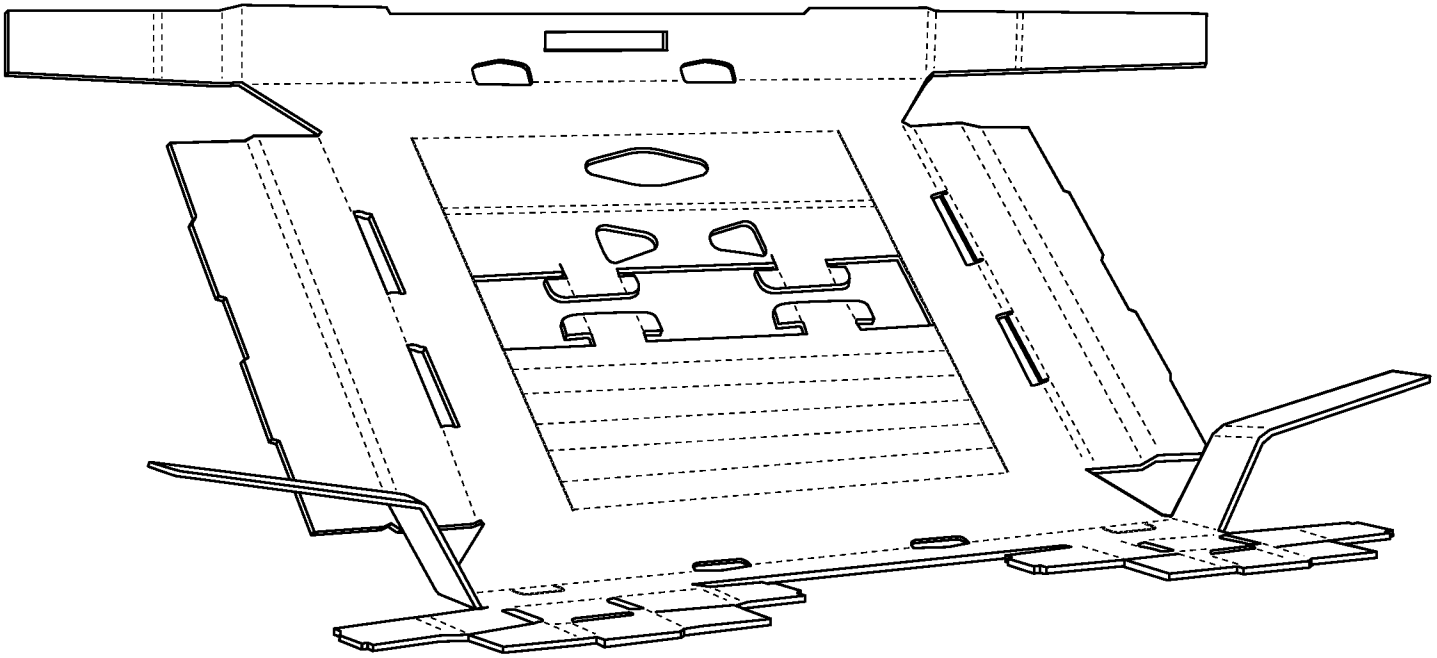
FIG. 4 shows a perspective view of the blank shown in FIG. 3 partially assembled into the insert according to various embodiments.
Figure 5:
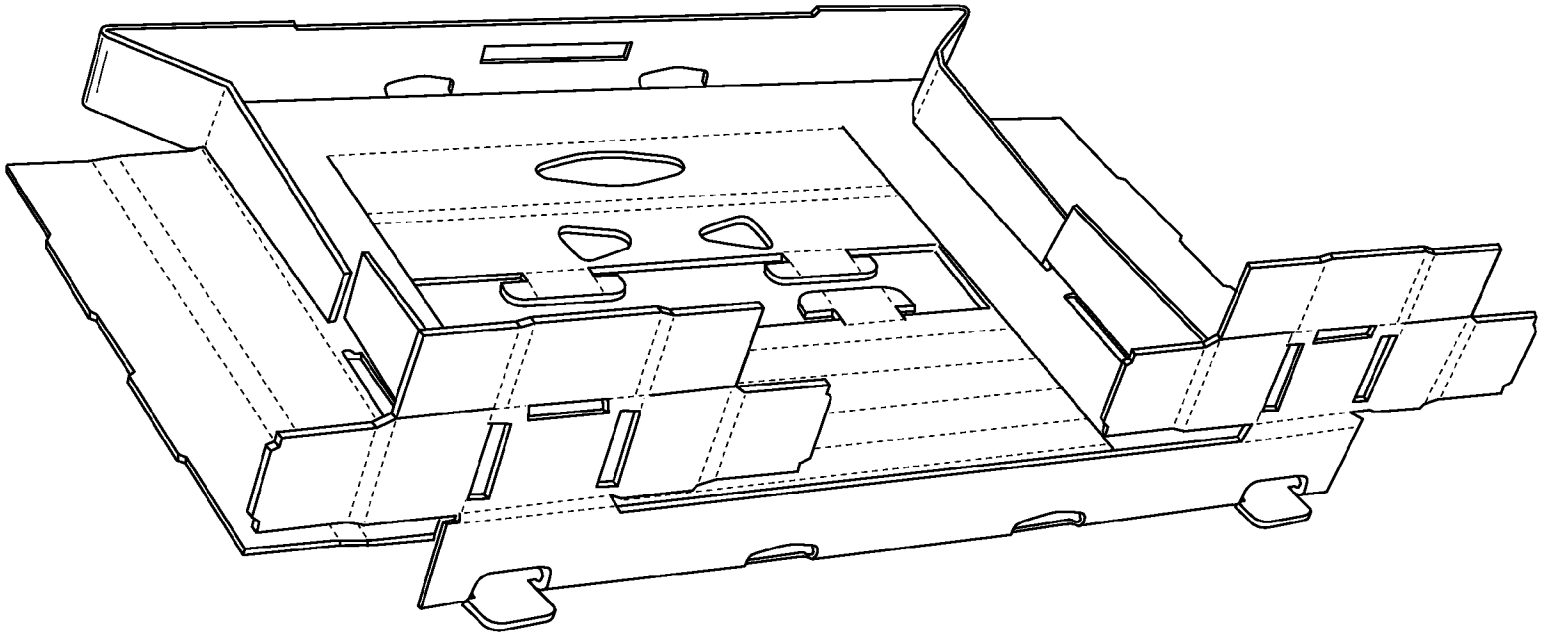
FIG. 5 shows a perspective view of the blank shown in FIG. 3 partially assembled into the insert according to various embodiments.

Turning to FIGS. 4-5, an individual performing the sequence of folding steps on the blank 100 may begin by folding the first side wall 120 along a single crease line 121 between the first side wall 120 and the bottom panel 160 at an approximate right angle and folding the fourth side wall 130 along a single crease line 131 between the fourth side wall 130 and the bottom panel 160 at an approximate right angle so that the first side wall 120 and the fourth side wall 130 are substantially parallel to and facing one another. The individual may continue by folding the second fold-over panel 127 of the first side wall 120 inward along the double crease lines 128 until a lower edge of the second fold-over panel is substantially aligned with and at an approximate right angle to one of the flanges 165 of the bottom panel 160, as shown in FIG. 5. Once so aligned, the individual may then fold the first fold-over panel 125 of the first side wall 120 outward relative to the second fold-over panel and along the double crease lines 126. The first fold-over panel 125 should be so folded outward until a lower edge of the first fold-over panel is substantially aligned with and at an approximate right angle to the crease line 144 of the second side wall 140, as likewise shown in FIG. 5.

With reference for a moment to FIG. 1, it should be appreciated that, as has been described previously herein, various embodiments of the blank 100 comprise a first side wall 120 having a pair of first and second fold-over panels 125, 127 and associated crease lines 126, 128, each positioned at opposing ends of the first side wall 120. Accordingly, in certain embodiments, virtually simultaneously with or immediately following the sequence of steps described above with respect to a first (e.g., the left-facing) of the pair of first and second fold-over panels and associated crease lines, the individual performing the sequence of folding steps may perform substantially the same sequence of steps with respect to the second (e.g., the right-facing) of the pair, as may be understood as well from at least FIGS. 4-5. Of course, it should be understood that the first fold-over panel 125 in this instance would be substantially aligned with and at an approximate right angle to the crease line 154 of the third side wall 150, as opposed to corresponding portions of the second side wall 140.

Remaining still with FIGS. 1 and 4-5 the individual performing the sequence of folding steps on the blank 100 may continue by folding the second fold-over panel 137 of the fourth side wall 130 inward along the double crease lines 138 until a lower edge of the second fold-over panel is substantially aligned with and at an approximate right angle to one of the flanges 165 of the bottom panel 160, as shown in FIG. 5. Once so aligned, the individual may then fold the first fold-over panel 135 of the fourth side wall 130 outward relative to the second fold-over panel and along the double crease lines 136. The first fold-over panel 135 should be so folded outward until a lower edge of the first fold-over panel is substantially aligned with and at an approximate right angle to the crease line 144 of the second side wall 140, as likewise shown in FIG. 5.

As in the context of the first side wall 120, various embodiments of the fourth side wall 130 likewise comprise a pair of first and second fold-over panels 135, 137 and associated crease lines 136, 138, each positioned at opposing ends of the fourth side wall. Accordingly, in certain embodiments, virtually simultaneously with or immediately following the sequence of steps described above with respect to a first (e.g., the left-facing) of the pair of fold-over panels and associated crease lines, the individual performing the sequence of folding steps may perform substantially the same sequence of steps with respect to the second (e.g., the right-facing) of the pair, as may be understood as well from at least FIGS. 4-5. Of course, it should be understood that the first fold-over panel 135 in this instance would be substantially aligned with and at an approximate right angle to the crease line 154 of the third side wall 150, as opposed to corresponding portions of the second side wall 140.

Figure 6:
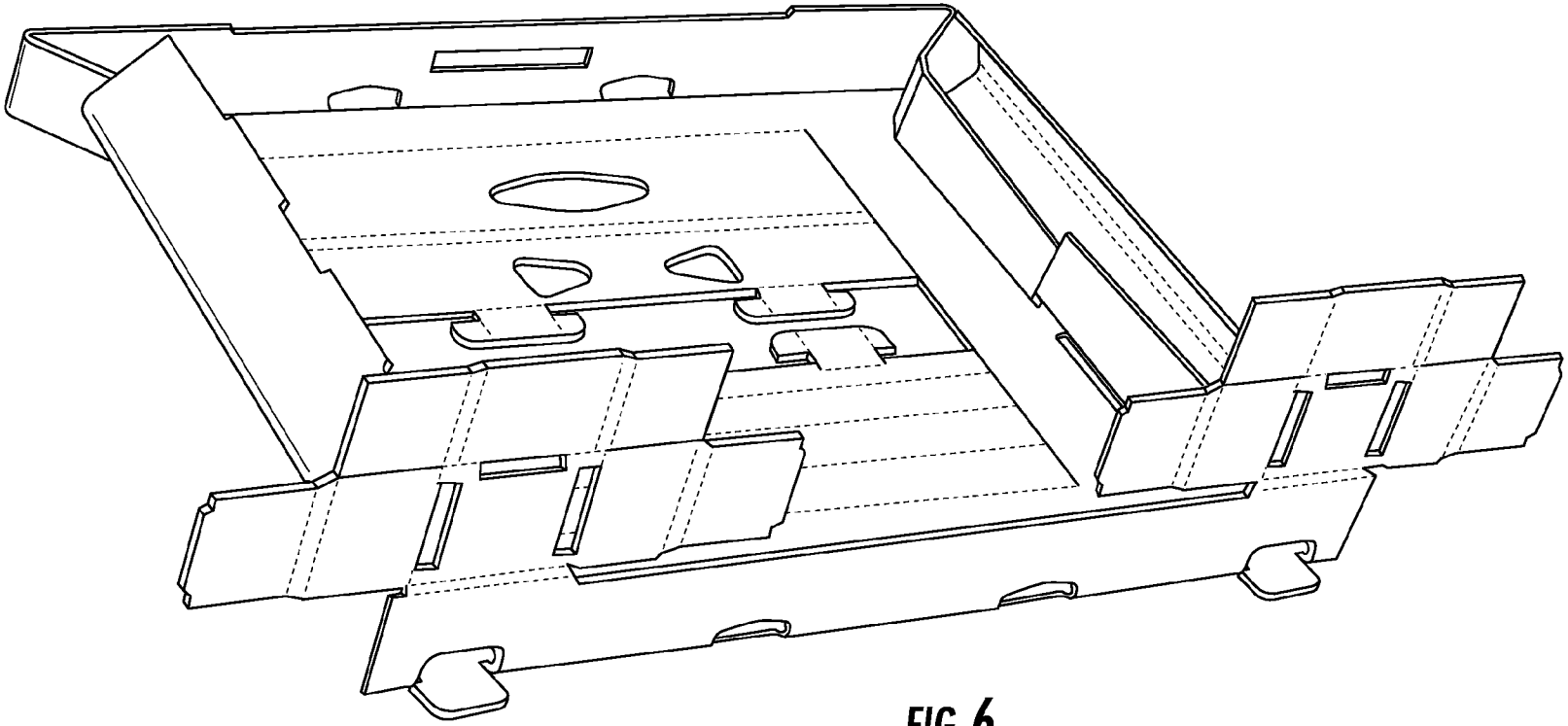
FIG. 6 shows a perspective view of the blank shown in FIG. 3 partially assembled into the insert according to various embodiments.
Figure 7:
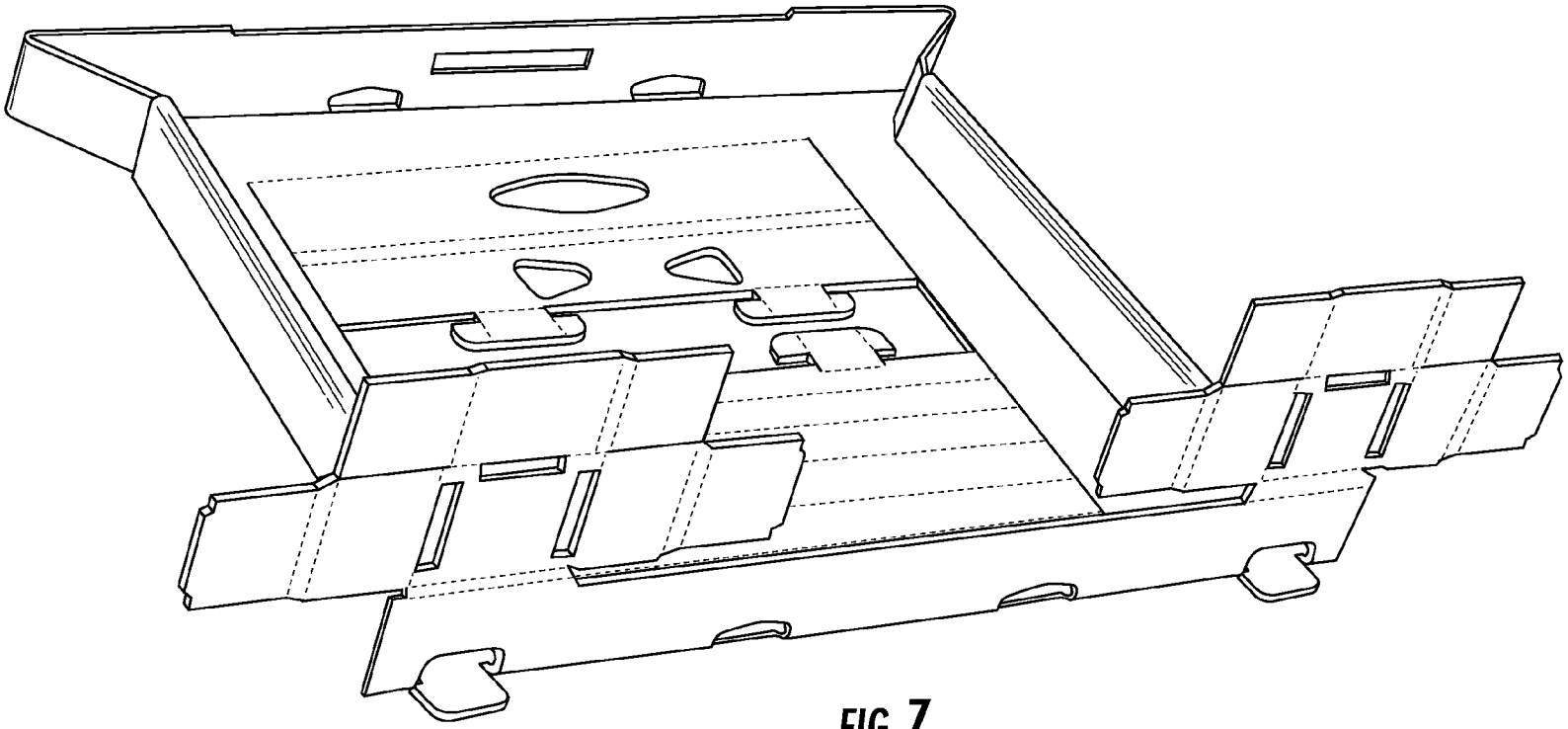
FIG. 7 shows a perspective view of the blank shown in FIG. 3 partially assembled into the insert according to various embodiments.

Turning now to FIGS. 1 and 6-7, the individual performing the sequence of folding steps on the blank 100 may continue by folding the second fold-over panel 143 of the second side wall 140 upward and inward along the crease line 144 until the panel is substantially adjacent and parallel to an exterior surface (not numbered, but see also FIG. 5) of the first fold-over panels 125, 135 of the first and fourth side walls 120, 130, respectively. Returning now to FIG. 6, the individual may continue by folding the first fold-over panel 141 of the second side wall 140 inward along the double crease lines 142 until the panel is substantially adjacent and parallel to a surface of the first fold-over panels 125, 135 substantially opposite that of the exterior surface described above. In other words, in these and other embodiments, the second side wall 140, once so folded, is configured to substantially immobilize, encase and enclose the first fold-over panels 125, 135 of the first and fourth side walls 120, 130, respectively. In certain embodiments, first and second side panels 141, 143 may be further secured relative to the panels 125, 135 by inserting tabs 145 of the panel 141 into corresponding apertures 146 formed substantially adjacent the bottom panel 160. It should be understood, of course, that the order of folding the first and second fold-over panels 141, 143 may be reversed, or even performed substantially simultaneously, as may be desirable for particular applications.

Remaining with FIGS. 6-7, virtually simultaneous with or following the folding the second side wall 140 as described above, the individual performing the sequence of folding steps on the blank 100 may continue by folding the second fold-over panel 153 of the third side wall 150 upward and inward along the crease line 154 until the panel is substantially adjacent and parallel to an exterior surface (not numbered, but see also FIG. 5) of the first fold-over panels 125, 135 of the first and fourth side walls 120, 130, respectively. Returning now to FIG. 6, the individual may continue by folding the first fold-over panel 151 of the third side wall 150 inward along the double crease lines 152 until the panel is substantially adjacent and parallel to a surface of the first fold-over panels 125, 135 substantially opposite that of the exterior surface described above. In other words, in these and other embodiments, the third side wall 150, once so folded, is configured to substantially immobilize, encase and enclose the first fold-over panels 125, 135 of the first and fourth side walls 120, 130, respectively. In certain embodiments, first and second side panels 151, 153 may be further secured relative to the panels 125, 135 by inserting tabs 155 of the panel 151 into corresponding apertures 156 formed substantially adjacent the bottom panel 160.

It should be understood, of course, that the order of folding the first and second fold-over panels 151, 153 may be reversed, or even performed substantially simultaneously, as may be desirable for particular applications. Still further, it should be understood that the order of folding the various panels of the second and third side walls 140, 150 may be reversed, or even performed substantially simultaneously, as they both are configured to generally function so as to retain and enclose the first fold-over panels 125, 135 of the first and fourth side walls 120, 130, respectively Turning now to FIGS. 2A and 8-9, the individual performing the sequence of folding steps on the blank 100 may continue by folding respective panels of one of the cube portions 170 (e.g., either the left-hand or right-hand positioned portion). In so doing, the individual may simultaneously or sequentially fold the pair of first fold-over panels 171 one of the cube portion 170 inward along the crease line 172 until the panel is substantially perpendicular to the unfolded second fold-over panel 174 and substantially parallel to the second side wall 140. In so doing, the pair of first fold-over panels 171 will separate from the fourth fold-over panels 180 along slit 173. Virtually simultaneous with or following the folding of the pair of first fold-over panels 171, the individual performing the sequence of folding steps on the blank 100 may continue by folding the single second fold-over panel 174 of the cube portion 170 downward and inward along the crease line 175 until the panel is substantially perpendicular to the unfolded fifth fold-over panel 183. It should be understood, of course, that the order of folding the first and second fold-over panels 171, 174 of the cube portion 170 may be reversed, or even performed substantially simultaneously, as may be desirable for particular applications.

Figure 8:
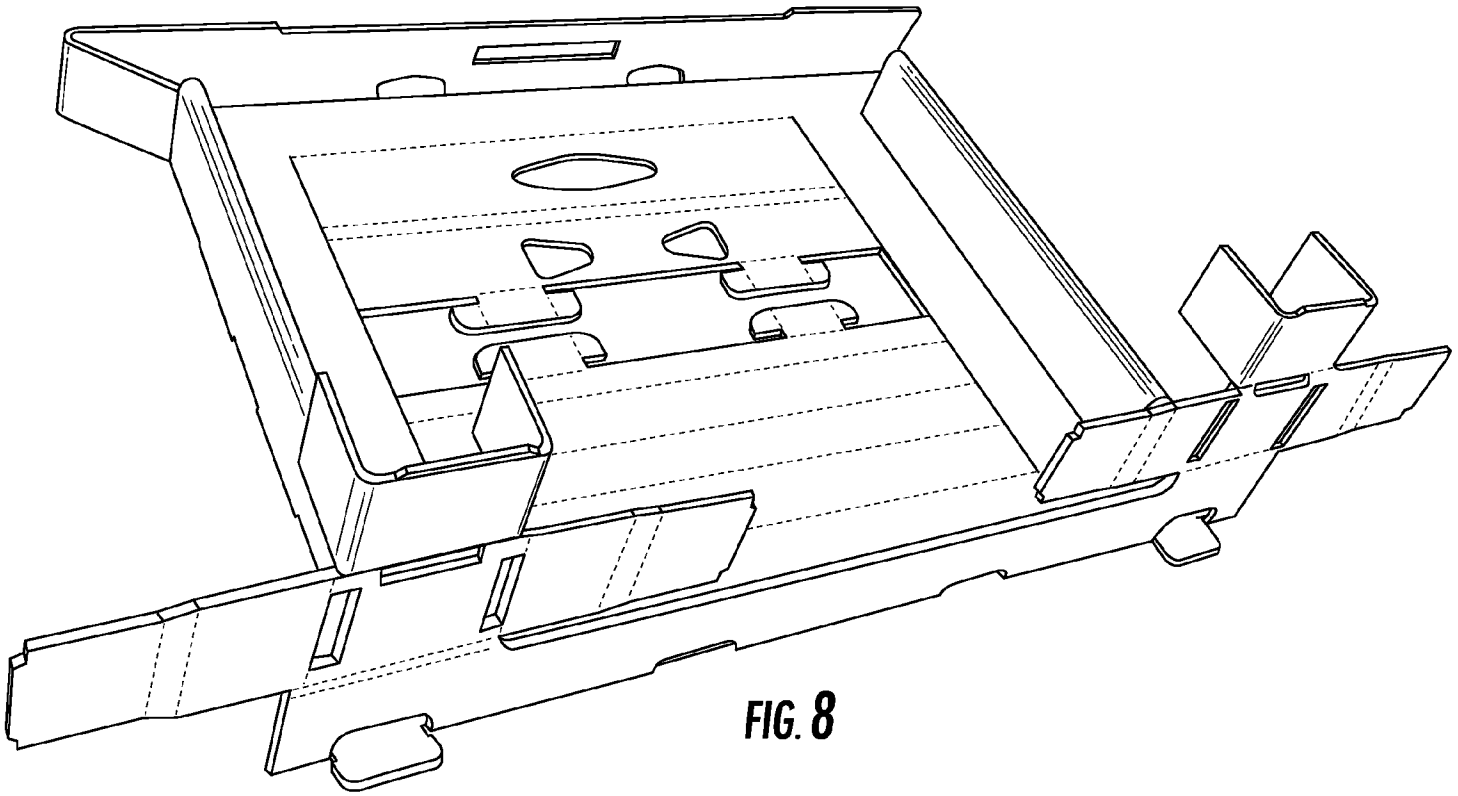
FIG. 8 shows a perspective view of the blank shown in FIG. 3 partially assembled into the insert according to various embodiments.
Figure 9:
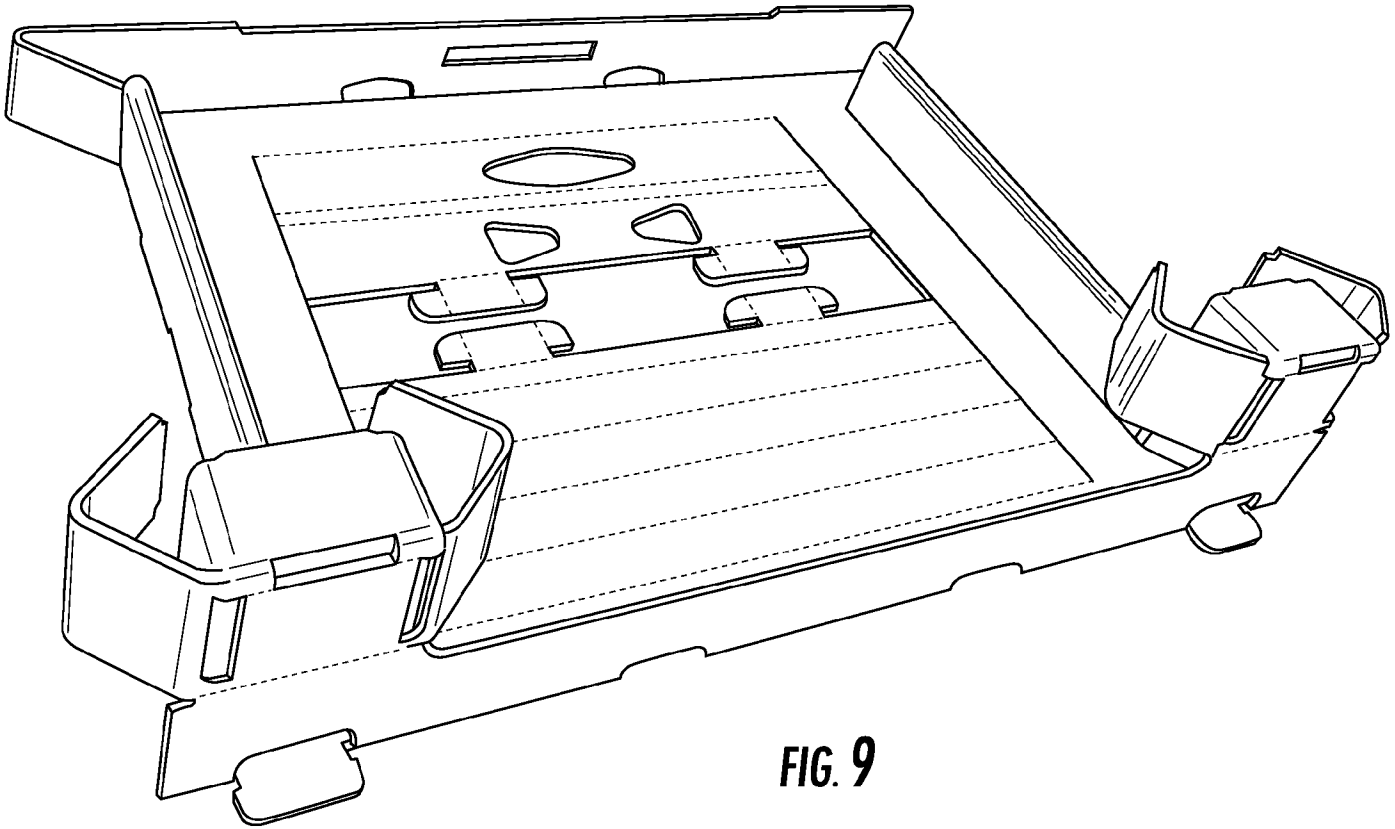
FIG. 9 shows a perspective view of the blank shown in FIG. 3 partially assembled into the insert according to various embodiments.

Remaining with FIGS. 2A and 8-9, the individual performing the sequence of folding steps on the blank 100, once folding the first and second fold-over panels 171, 174 of the cube portion 170, may continue by folding the pair of fourth fold-over panels 180 of the cube portion, whether simultaneously or sequentially, inward along the crease line 181 until the panels are substantially adjacent and parallel to an exterior surface (not numbered, but see in particular FIG. 8) of the second fold-over panels 174. The individual may then fold the pair of third fold-over panels 177 of the cube portion 170 inward along the double crease lines 178 until the panels are substantially adjacent and parallel to a surface of the second fold-over panels 174 substantially opposite that of the exterior surface described above. In other words, in these and other embodiments, the third and fourth fold-over panels 177, 180 of the cube portion 170, once so folded, are configured to substantially encase and enclose the second fold-over panels 174. In certain embodiments, the second, third, and fourth fold-over panels 174, 177, 180 are further secured relative to one another by inserting tabs 179 of the third fold-over panels into corresponding apertures 182 substantially adjacent the first fold-over panels 171.

Figure 10:
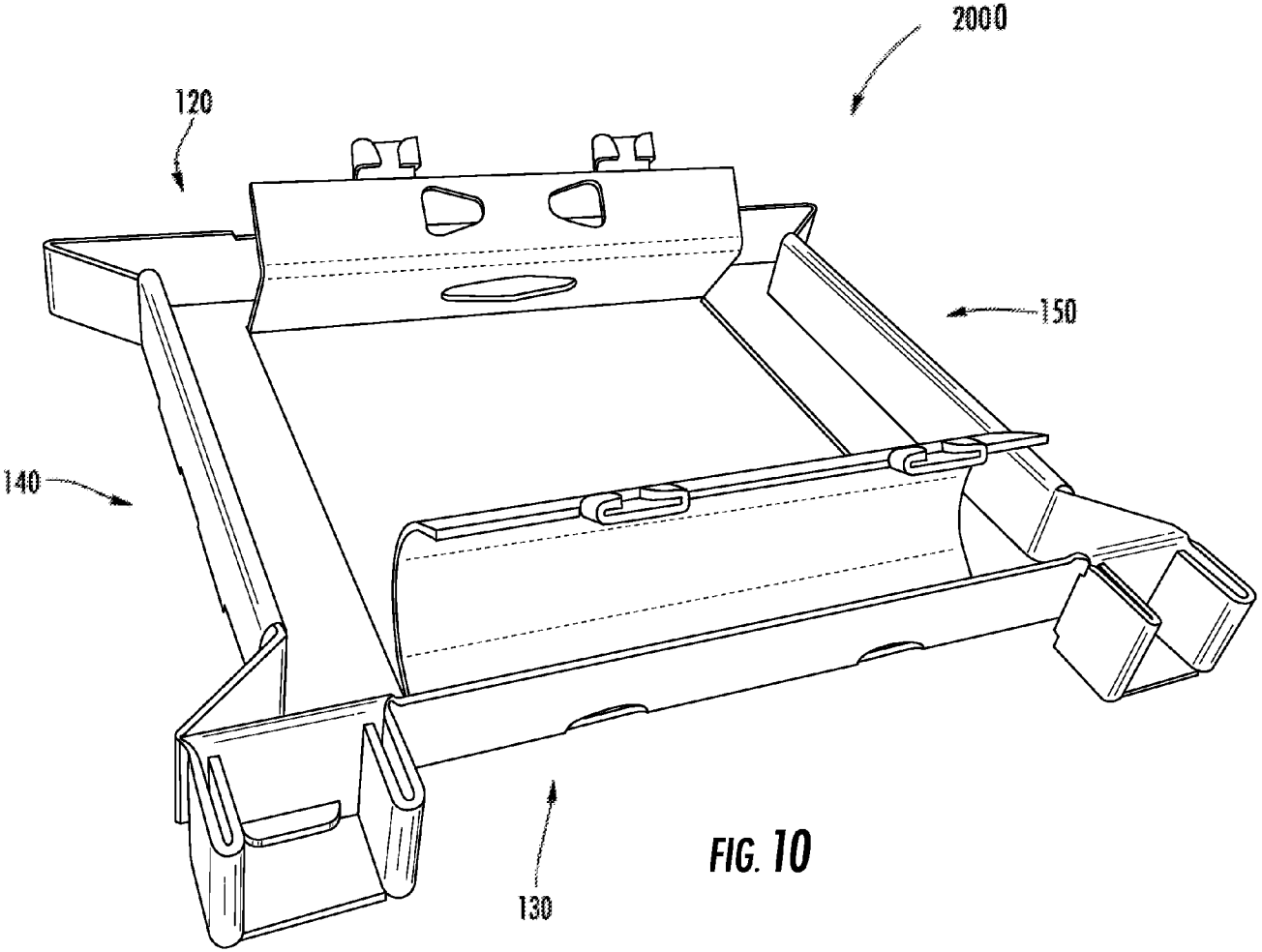
FIG. 10 shows a perspective view of the blank shown in FIG. 3 partially assembled into the insert according to various embodiments.

Turning now to FIGS. 2A and 10, the individual performing the sequence of folding steps on the blank 100, once folding the first, second, third, and fourth fold-over panels 171, 174, 177, and 180 of the cube portion 170, whether simultaneously or sequentially (or even in alternative order of folds), may continue by folding the fifth fold-over panel 183 outward along the crease line 184 until the panel is substantially adjacent and parallel to an exterior surface (not numbered) of the fourth side wall 130. In certain embodiments, once so folded, the fifth fold-over panel 183, and indeed the cube portion 170 in its entirety, may be further secured relative to the fourth side wall 130 by inserting tabs 133 of the fourth side wall through the corresponding aperture 176 formed at substantially the intersection of the second and fifth fold-over panels 174, 183, respectively.

With reference now to FIGS. 2A and 7-10, it should be understood that according to various embodiments, once having folded respective panels of one of the cube portions 170 (e.g., either the left-hand or right-hand positioned portion), the individual performing the sequence of folding steps on the blank 100 may repeat substantially the same steps, whether in substantially the same manner or otherwise, on the remaining unfolded cube portion 170. As such, for purposes of brevity, the repetitious folding steps have not been separately described herein with reference to each respective cube portion 170. Of course, it should be understood that where possible variations in order of folding of the cube portions 170 have been noted, the procedures may be substantially the same in certain embodiments and/or substantially differing in other embodiments, relative to one another, as may be desirable for particular applications.

Figure 11:
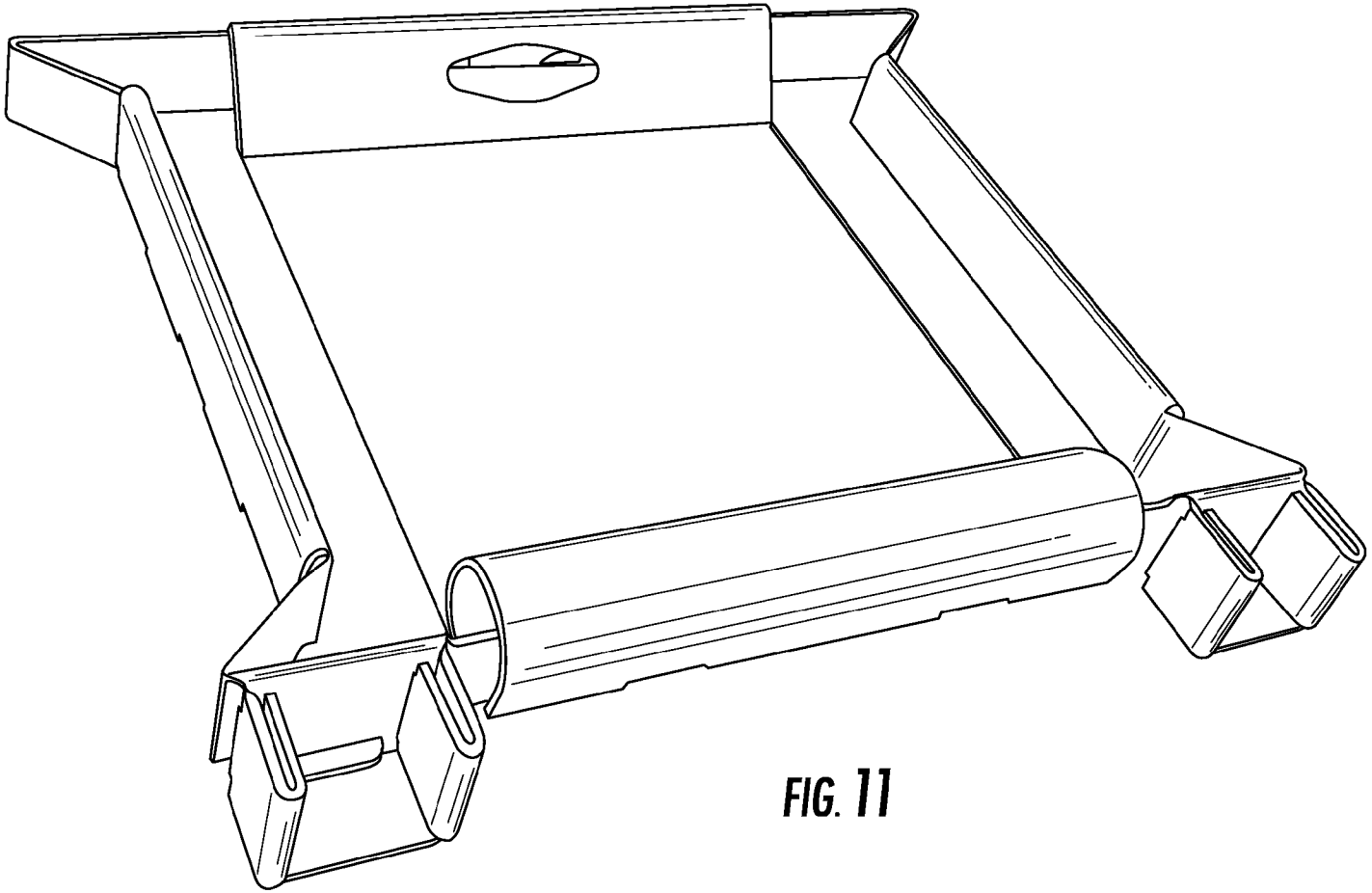
FIG. 11 shows a perspective view of the blank shown in FIG. 3 fully assembled into the insert according to various embodiments.

Turning now to FIGS. 10-11, the individual performing the sequence of folding steps on the blank 100, once folding the cube portions 170, may continue by simultaneously or sequentially folding various panels of a first walled enclosure portion 166 and a second walled enclosure portion 168 relative to the bottom panel 160 such that various panels of the portions 166, 168 substantially separate from the bottom panel 160 along slits 204, 206, 224, and 226. It should be understood that, according to various embodiments, the respective order of folding the two portions 166, 168, and even that of the various panels contained thereon, may be varied, modified, or even reversed, as may be desirable for particular applications. That being said, the following description should be considered exemplary and not in any shape or fashion limiting in scope or content.

With particular reference to FIGS. 2B and 10, the individual may first fold the first fold-over panel 190 slightly upward and inward along crease line 191 such that the panel substantially separates from the bottom panel 160 along respective and opposing slits 204, 206. The individual may then continue by folding the second fold-over portion 200 of the first walled enclosure portion 166 upward and inward along the crease line 201 until the panel likewise separates along slits 204, 206, and further until the double crease line 191 is substantially adjacent to the receiving edge portion 129 of the first side wall 120 (see also FIG. 1). Once the second fold-over portion 200 is so positioned, the individual may continue performing the sequence of folding steps on the blank 100 may then fold the first fold-over panel 190 downward and inward along the double crease line 191 until the tabs 193 of the panel are substantially adjacent the apertures 122 of the first side wall 120, thereby substantially enclosing at least a portion of the first side wall inside the respective panels of the first walled enclosure portion 166. In certain embodiments, the tabs 193 may be further inserted through the apertures 122, so as to secure the first walled enclosure portion 166 relative to the first side wall 120.

Continuing to refer to FIGS. 2B and 10-11, the individual performing the sequence of folding steps on the blank 100 may continue (sequentially after or, alternatively before the above steps associated with the first walled enclosure portion 166) by folding the first fold-over panel 210 of the second walled enclosure portion 168 upward and inward along the crease line 211 until the first fold-over portion is substantially separated from the bottom panel along slits 224, 226. Once the first fold-over portion 210 is so positioned relative to the bottom panel 160, the individual may continue by sequentially or essentially simultaneously folding each of a plurality of additional fold-over panels 220 inward and upward along respective and corresponding crease lines 221, until the panels 220 are likewise separated relative to the bottom panel along slits 224, 226. In various embodiments, such results in a "rolled-up" configuration of the second walled enclosure portion 168, the use of which will be described in further detail below.

Once so configured, with continued reference to FIGS. 2B and 10-11, the individual performing the sequence of folding steps may continue by folding the first fold-over panel 210 of the second walled enclosure portion 168 further upward and inward until the tabs 213 of the panel are substantially adjacent the apertures 132 of the fourth side wall 130, thereby substantially enclosing at least a portion of the fourth side wall inside the respective plurality of panels 210, 220 of the second walled enclosure portion 168. In certain embodiments, the tabs 213 may be further inserted through the apertures 132, so as to secure the second walled enclosure portion 168 relative to the fourth side wall 130.

Figure 2C:
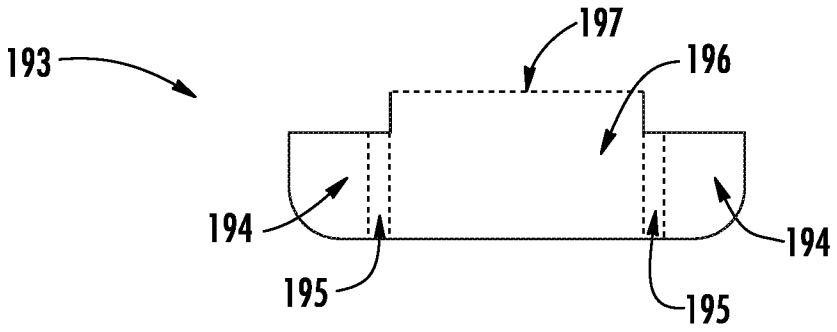
FIG. 2C shows an enlarged top view of an arrangement according to various embodiments of a tab 193 of the bottom panel 160 of FIG. 2B.
Figure 2D:
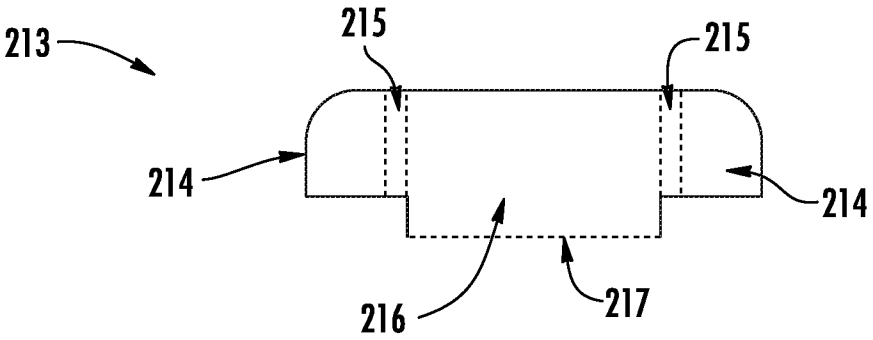
FIG. 2D shows an enlarged top view of an arrangement according to various embodiments of a tab 213 of the bottom panel 160 of FIG. 2B.

With reference now to FIGS. 2C-D and also FIGS. 10-11, it should also be understood that in various embodiments, the individual performing the sequence of folding steps, when inserting any of the tabs 193, 213 of the walled enclosure portions 166, 168 into and through apertures 122, 132, additional folding steps may be necessary upon the tabs themselves. In certain embodiments, the individual may, prior to inserting the tabs 193, 213 into apertures 122, 132, first fold a pair of first fold-over panels 194, 214 upward and inward along double crease lines 195, 215 until such are substantially perpendicular to a second fold-over panel 196, 216 of the tabs. In these and still other embodiments, the individual may then fold the second fold-over panels 196, 216 upward and inward along crease lines 197, 217 until such are substantially perpendicular to the first fold-over portions 190, 210 of the walled enclosure portions 166, 168. Once so configured, the individual may then insert the tabs 193, 213 into and through the apertures 122, 132, respectively, such that the first fold-over panels 194, 214 will substantially retain the tabs within the apertures, at least against inadvertent removal lacking a certain degree of force.

With continued reference to FIGS. 2B and 10-11, in various embodiments, the apertures 192 in the first fold-over panel 190 of the first walled enclosure portion 166 and the hole 123 of the first side wall 120 are substantially aligned relative to one another in the folded position so that at least a portion of a handle portion 1020, which may be snapped and secured within the hole 123 (see also FIGS. 12D-E) may pass through the apertures 192 unrestricted (e.g., when placing or removing a garment in the insert, as will be described in further detail below). In certain embodiments, the handle portion 1020 may be pre-formed and positioned within the insert, while in other embodiments, the individual performing the sequence of folding steps upon the blank 100 may need to, as some point, position the handle portion 1020 appropriately within the hole 123.

With continued reference to FIGS. 2B and 10-11, in various embodiments, the aperture 202 in the second fold-over panel 200 of the first walled enclosure portion 166 is substantially aligned, in its folded configuration (as described previously herein) so as to permit passage of a hanger 1030 (see FIG. 12E) there-through so as to hang a garment relative to the insert and by (e.g., from) the handle portion 1020 previously described herein. In at least the illustrated embodiments, the handle portion 1020 may be configured with an adjustable handle 1029 configured to engage and secure the hanger 1030, and a set of flanges 1028 configured to secure the adjustable handle 1029 relative to the handle portion 1020 (as may be seen from not only FIG. 12E, but also FIG. 12D).

III. Exemplary Use of Garment Box

As mentioned above, FIGS. 12A-E and 13 display a constructed insert 1001 for a garment box 1000 according to various embodiments of the invention. To use the insert 1001, an individual places garments 1002 on a hanger 1030 (such as, for example, a suit on a hanger) and positions the same onto the insert 1001. This may be accomplished in various embodiments by the individual inserting the head of the hanger 1030 into and through the aperture 202 of the first walled enclosure portion 166 and hooking the same over the adjustable handle 1029 of the handle portion 1020. Once the hanger 1030 is so secured, the individual may wrap the garment 1003 around the second walled enclosure portion 168, in particular around the "rolled up" configuration created by the folding of the plurality of fold-over portions 210, 220 of the enclosure portion, ensuring during the process that the garment remains smooth and unwrinkled. Once the garment is wrapped around the "rolled up" portion of the second walled enclosure portion 168, the individual may pull the lower portion (e.g., edges) of the garment upward (e.g., back toward the first walled enclosure portion 166. In various embodiments, at least two securing mechanisms 1010 (see FIG. 12A) may be used to secure the lower portion or edge of the garment relative to at least a portion of the first side wall 120. In at least the illustrated embodiment, as has been described previously herein, the securing mechanisms 1010 may comprise a set of clips 1011, 1013 interconnected with an elastic line 1012. Of course, alternative types and/or configurations of securing mechanisms may be envisioned, also as previously described herein.

Figure 13:
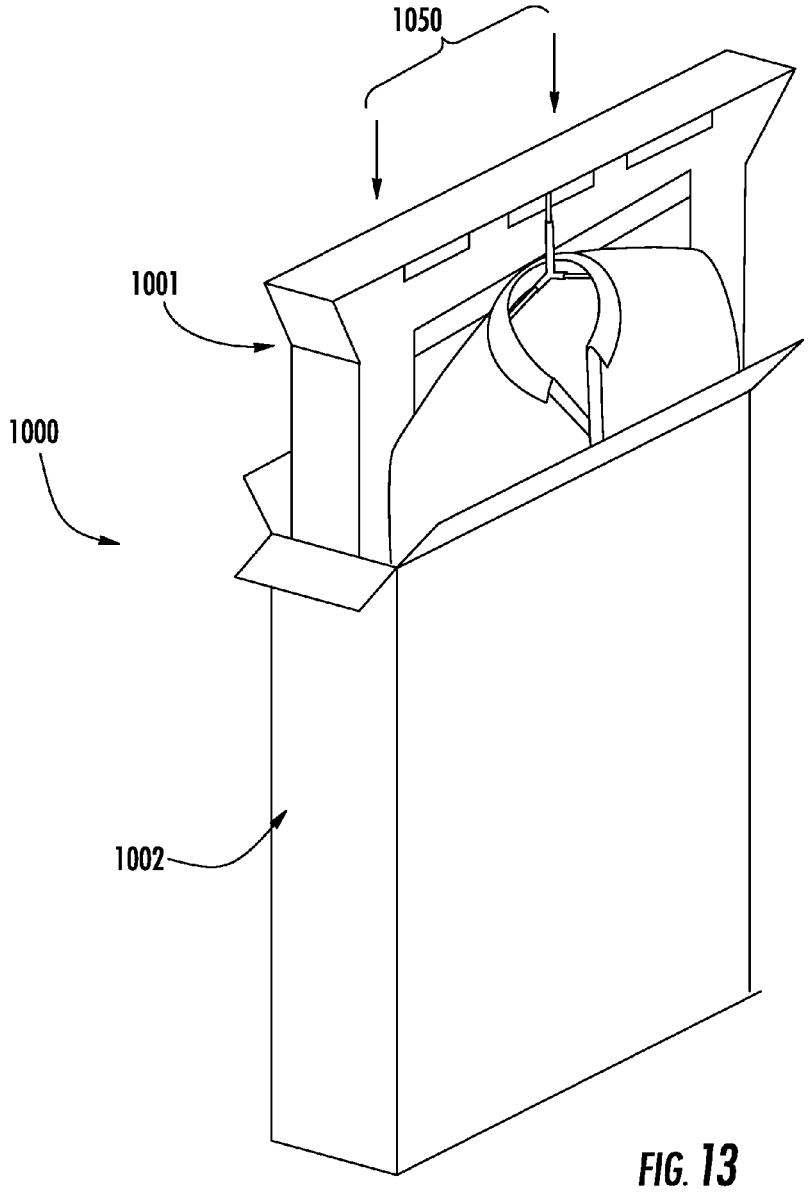
FIG. 13 shows a perspective view of an outer shell of a garment box configured according to various embodiments for receiving at least one of the inserts of FIG. 12A.

In any case, in any of these and still other various embodiments, once the garment 1003 has been positioned and secured relative to the insert 1001, the user may place the insert into an outer shell 1002 (e.g., box) for transport (see FIG. 13). As should be understood from the illustrated embodiment, certain inserts and shells 1001, 1002, may be configured such that exerted a force in a direction 1050 will slide one insert into one shell. However, in still other embodiments (not shown), two or more inserts 1001 may be inserted within a single shell 1002 for transport. Of course, in any of these and other embodiments, it should be understood that while the shells 1002 may be specially configured for use with the inserts 1001, in still other embodiments, the shells 1002 may be selected from any of a variety of known and commonly used standard-sized shipping containers, for which the inserts 1001 (and associated blanks 100), as have been described herein, may be specially configured to correspond with from a dimensional perspective.

With continued reference to FIG. 13, it should be further understood that while the illustrated embodiment shows a shell 1002 sized and shaped to substantially mate with and receive a single insert 1001, the shells in still other embodiments may, to some degree, larger than the inserts, thereby facilitating placement of foam, paper, bubble wrap, etc. within the shell and alongside the insert, so as to, amongst other possible benefits, further secure and protect the enclosed garments. In any of these described and still further embodiments, the garment box 1000, as formed from the assembled insert 1001 and the outer shell 1002, and further from the folded blank 100, as described elsewhere herein, facilitate transport of garments within the same in a number of different orientations during shipping without the garments becoming curled up, disarranged, disheveled, and/or wrinkled.

IV. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for making a garment box insert, wherein the garment box insert comprises a bottom panel and a container portion comprising a first side wall, a second side wall, a third side wall, and a fourth side wall, each adjacent to the bottom panel, the first side wall and the fourth side wall being on opposite sides of the bottom panel from one another, the first side wall comprising one or more substantially oval slots and an elongate slot disposed proximate a mid-point of the first side wall and configured to receive and secure a handle portion wherein the handle portion is configured to be engaged by one or more heads of clothes hangers, the second side wall and the third side wall being on opposite sides of the bottom panel from one another, and adjacent to the first side wall and the fourth side wall; and contiguous to the first side wall, a first walled enclosure portion comprising: one or more tabs, a first fold over panel comprising two apertures substantially centered about a mid-point of the first fold over panel , a second fold over panel adjacent an inside edge of the first fold over panel and comprising an elongate aperture located proximate a mid-point of the second fold over panel, opposing ends of the elongate aperture being approximately aligned with the two apertures of the first fold over panel and a central portion of the elongate aperture being approximately aligned with the elongate slot located in the first side wall, the method comprising the steps of:

(a) folding the first side wall, the second side wall, the third side wall, and the fourth side wall at approximate right angles relative to the bottom panel so that the first side wall and the fourth side wall are substantially parallel to and facing one another and the second side wall and the third side wall are substantially parallel to and facing one another;

(b) forming the container portion by performing the sub-steps of:

(1) folding extended flap portions of the first and the fourth side walls such that the extended flap portions are positioned inside the walled enclosure portion and lie substantially juxtaposed with said second and third side walls; and (2) folding down the first fold over panels of the second and the third side walls such that the first fold over panels and corresponding second fold over panels of the second and the third side walls substantially enclose at least a portion of the extended flap portions of the first and the fourth side walls and such that an outer edge of the first fold over panels lays in juxtaposition with the bottom panel; and (c) forming the first walled enclosure portion by performing the sub-steps of:

(1) folding up the second fold over panel such that the central portion of the elongate aperture is approximately aligned with the elongate slot located in the first side wall, such that the one or more heads of clothes hangers can be inserted through the elongate aperture of the second fold over panel and secured on a lower portion the handle portion;

(2) folding down the first fold over panel such that the first fold over panel lies juxtaposed an outer surface of the first side wall and such that the two apertures are aligned so as to receive at least an upper portion of the handle portion; and (3) inserting said one or more tabs of the first walled enclosure portion into said one or more substantially oval slots of the first side wall, so as to selectively secure the first walled enclosure portion relative to the first side wall during use.

2. The method of claim 1, wherein the garment box insert further comprises, contiguous to the fourth side wall, a second walled enclosure portion comprising one or more tabs and a plurality of fold over panels configured to form a curved surface relative to the fourth side wall, the method further comprising the steps of:

forming the second walled enclosure portion by performing the sub-steps of:

(1) folding up each of the plurality of fold over panels such that the panels form a curved surface relative to the fourth side wall, the curved surface being configured to receive and selectively retain a garment during handling and shipping of the garment box containing the garment box insert; and (2) inserting said one or more tabs of said second walled enclosure portion into one or more substantially oval slots of said fourth side wall, so as to selectively secure the second walled enclosure portion relative to the fourth side wall during use.

3. The method of claim 2, wherein said garment box insert further comprises a pair of foldable portions and said method further comprises the step of folding the pair of foldable portions outward relative to said container portion of said garment insert such that the foldable portions are positioned substantially adjacent opposing ends of said second walled enclosure portion and exterior relative to said container portion, such that the foldable portions substantially prevent contact of said garment box with said second walled enclosure portion and said garment smoothly positioned adjacent thereto during handling and shipping of the garment box.

4. The method of claim 2 further comprising selectively attaching a pair of clips relative to said first side wall, such that said pair of clips are configured to selectively secure a lower portion of the garment upon positioning of a middle portion of the garment substantially adjacent the second walled enclosure portion.

* * * * *